US005455002A

United States Patent [19]

Kobayashi et al.

[11] Patent Number: 5,455,002

[45] Date of Patent: Oct. 3, 1995

[54] PLASTIC WORKING METHOD FOR HOLED METAL PARTS

[75] Inventors: Kazuto Kobayashi; Toshio Suzuki, both of Sagamihara; Takashi Nakano, Tsukui, all of Japan

[73] Assignee: Aida Engineering, Ltd., Kanagawa, Japan

[21] Appl. No.: 217,310

[22] Filed: Mar. 23, 1994

Related U.S. Application Data

[63] Continuation-in-part of Ser. No. 9,323, Jan. 26, 1993, abandoned.

[30] Foreign Application Priority Data

Mar. 12, 1992 [JP] Japan ..... 4-053704

[51] Int. Cl.[6] ..... B22F 3/03

[52] U.S. Cl. ..... 419/66; 419/61

[58] Field of Search ..... 264/109, 119, 264/120, 123, 320; 419/66, 61

[56] References Cited

U.S. PATENT DOCUMENTS

| | | | |
|---|---|---|---|
| 2,357,407 | 9/1944 | Kurtz | 419/66 |
| 3,185,753 | 5/1965 | Haley | 264/123 |
| 4,853,180 | 8/1989 | Howard | 419/66 |
| 5,043,111 | 8/1991 | Hinzmann et al. | 264/40.5 |
| 5,122,319 | 6/1992 | Watanabe et al. | 264/109 |

*Primary Examiner*—Mary Lynn Theisen
*Attorney, Agent, or Firm*—Kalish & Gilster

[57] ABSTRACT

A plastic working method for making a holed metal part. A holed blank with a through hole is placed at the center in a die member which has a die and a container continuing to the die. The die is pushed toward a punch, inserting into the through hole a first portion of a mandrel which has cross sections with at least two different cross-sectional areas. The blank is compressed by a counter punch fitting with the container and a punch pressing the die end face of the die member toward the counter punch to cause the blank plasticly to flow into a space formed between the die hole of the die and the first portion of the mandrel and while applying a compressive force to the blank by the punch and the counter punch, pulling out the first portion of the mandrel out of the blank through hole while inserting a further portion of the mandrel into the through hole so as plastically to flow the blank into a gap between the first portion of the mandrel and the through hole. Other embodiments of the method are also disclosed.

15 Claims, 25 Drawing Sheets

PLASTIC WORKING METHOD FOR HOLED METAL PARTS

This application is a continuation-in-part of application Ser. No. 08/009,323 filed 26 Jan. 1993, now abandoned.

BACKGROUND OF THE INVENTION

1. Field of the Invention

This invention relates to a plastic working method for eliminating defects such as an underfill on the outer circumference when fabricating a holed metal part with a through hole at the center from a blank having a through hole at the center by plastic working, and particularly to a cold forging method.

2. Description of the Prior Art

FIG. 26 shows an example of a known conventional method for shaping a part having an identical cross section by plastic working.

In this method, the part having an identical cross section represents a part such as a spur gear which is free from a push residue which is seen on a gear formed by extrusion method.

In this method, a die 1 is provided with a die hole 3 shaped corresponding to the spur gear shown in FIG. 27, and an identical cross sectional shaped member 9 as shown in FIG. 27 is formed by a punch 5 and a counter punch 7 respectively fitting with each side of the die hole 3.

But, since this method needs to mate punch 5 with die 1, flashes are formed at a mated part 11 of punch 5 and die 1.

Further, where a holed metal part is a helical gear, inserting the punch into the die requires the punch because the tooth section of the punch and die hole is twisted, making it very difficult to form stably.

This phenomenon also takes place when a holed metal part 17 is formed by inserting a mandrel 15 into the center of a blank A as shown in FIG. 28.

FIG. 29 shows an improved plastic working method for such a holed metal part 17 wherein a die 19 and a container 21 are pushed toward a punch 25 by a spring member 23, and the blank A placed in the container 21 is compressed by the punch 25 and a counter punch 29.

This method does not require fitting of the punch 25 and the die 19, which results in no flash, and enables relatively easy shaping of a helical gear because the punch 25 is not required to be inserted in the die 19 the die structure can be simplified.

In the above plastic working method, when the blank A is compressed, it plastically flows successively from tooth root B to tooth top C shown in FIG. 27.

Therefore, a defect lies in the blank not easily flowing to reach tooth top C because a plastic flow distance is long, resulting in forming an underfill E at tooth top C.

If high stress is applied to blank A to decrease such an underfill E, a stress against die 19 is also increased, which may result in breakage of die 19.

Additionally, elastic deformation of die 19 is increased and a stress against the holed metal part 17 is increased, resulting in increasing a dimensional tolerance between the die and the holed metal part 17. It is difficult to obtain the holed metal part 17 with dimensional accuracy.

SUMMARY OF THE INVENTION

It is an object of this invention as a solution of the above problems to provide a plastic working method which can securely prevent occurrence of defects such as underfills and obtain a holed metal part with an accurate size.

According to a first preferred embodiment of this invention, the plastic working method for a holed metal part comprises placing a holed blank with a through hole at the center in a die member which has a die and a container continuing to the die, and is pushed toward a punch, inserting into the through hole a large cross sectional part of a mandrel, which has cross sections with at least two different cross-sectional areas, and compressing the blank by a counter punch fitting with the container and a punch pressing the die end face of the die member toward the counter punch. This compression of the blank and pressing of the die cause the blank to plastically flow into a space formed between the die hole of the upper die and the large cross sectional part of the mandrel while applying a compressive force to the blank by the punch and the counter punch. During this application of compressive force, the large cross sectional part of the mandrel is pulled out of the black through hole while inserting a small cross sectional part of the mandrel into the through hole so as to plastically flow the blank into a gap between the small cross sectional part of the mandrel and the through hole.

According to a second preferred embodiment of this invention, the plastic working method for a holed metal part comprises placing a holed blank with a through hole at the center in a die member which has a die and a container continuing to the die and is pushed toward a punch. The die member inserts into the punch side of the through hole, a small cross sectional part of a mandrel which has cross sections with at least two different cross-sectional areas, press fitting a diameter enlarging part, continuing to the small cross sectional part to the through hole to enlarge the punch side of the through hole. In the enlarging process, the blank is compressed by a counter punch fitting with the container and a punch pressing the die (end face of the die member) toward the counter punch to causing the blank to plastically flow into a space formed between the die hole of the upper die and the mandrel. At the same time, the punch and counter punch apply a compressive force which pulls the diameter enlarging part of the mandrel out of the blank through hole while inserting a small cross sectional part of the mandrel into the through hole. This allows the blank to plastically flow into a gap between the small cross sectional part of the mandrel and the through hole enlarged by the diameter enlarging part.

According to a third embodiment of the present invention, the plastic working method for a holed metal part comprises placing a holed blank with a through hole at the center in a die member which has a die and a container continuing to the die and is pushed toward a punch. A small cross sectional part of a mandrel which has cross sections with at least two different cross-sectional areas is inserted into the through hole. The blank is compressed by a counter punch fitting with the container and a punch pressing the die (end face of the die member) toward the counter punch, causing the blank to plastically flow into a space formed between the die hole of the upper die and the mandrel. The punch side of the through hole is enlarged by press fitting a diameter enlarging part continuing to the small cross sectional part of the mandrel to the through hole. By applying the punch and counter punch compressive force to the blank, the diameter enlarging part of the mandrel is pulled out of the blank through hole while inserting a small cross sectional part of the mandrel into the through hole so as to plastically flow the blank into a gap between the small cross sectional part of the mandrel and the through hole enlarged by the diameter enlarging part.

According to a preferred embodiment of this invention, the plastic working method for a holed metal part is characterized by its final process where the large cross sectional part or the diameter enlarging part of the mandrel is pulled out of the blank through hole with the compressive force applied to the blank. This action causes the small cross sectional part of the mandrel to be gradually inserted into the through hole so that the gap between the small cross sectional part of the mandrel and the through hole is filled with the blank. The entire blank makes plastic flow causing other parts such as tooth top to plastically flow, so that the underfill of the blank is gradually filled.

According to a preferred embodiment of this invention, the plastic working method for a holed metal part is characterized in that the large cross sectional part or the diameter enlarging part of the mandrel is gradually pulled out to form the small cross sectional part while placing the blank under the compressive force caused by the punch and the counter punch, and the blank plastically flows to the small cross sectional part of the mandrel to gradually fill the underfill. Thus, this method has an advantage of securely obtaining a holed metal part without defects such as underfills.

DESCRIPTION OF THE PREFERRED EMBODIMENT OF THE INVENTION

Referring to the attached drawings, preferred embodiments of this invention will be described in detail below.

First Embodiment

Figure 1:
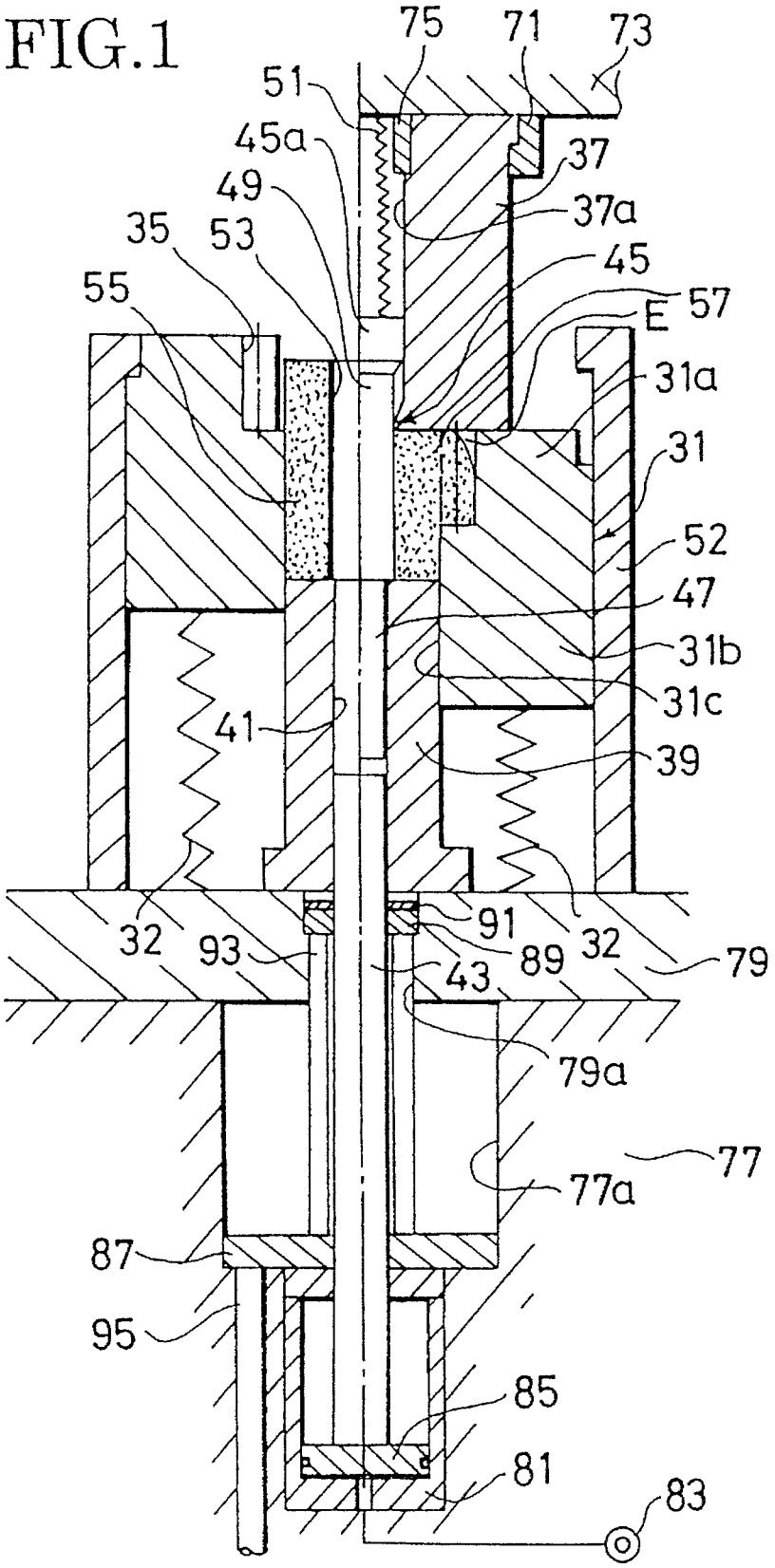
FIG. 1 is a cross sectional view of a plastic working device used in a first embodiment of the plastic working method for a holed metal part according to this invention.

FIG. 1 shows a plastic working device used in a first embodiment of the plastic working method for a holed metal part according to this invention. In the figure, the reference numeral 31 indicates a die member.

The die member 31 comprises a die 31*a* and a container 31*b* continuing from the die 31*a*, and is pushed upward by a spring 32.

Figure 2:
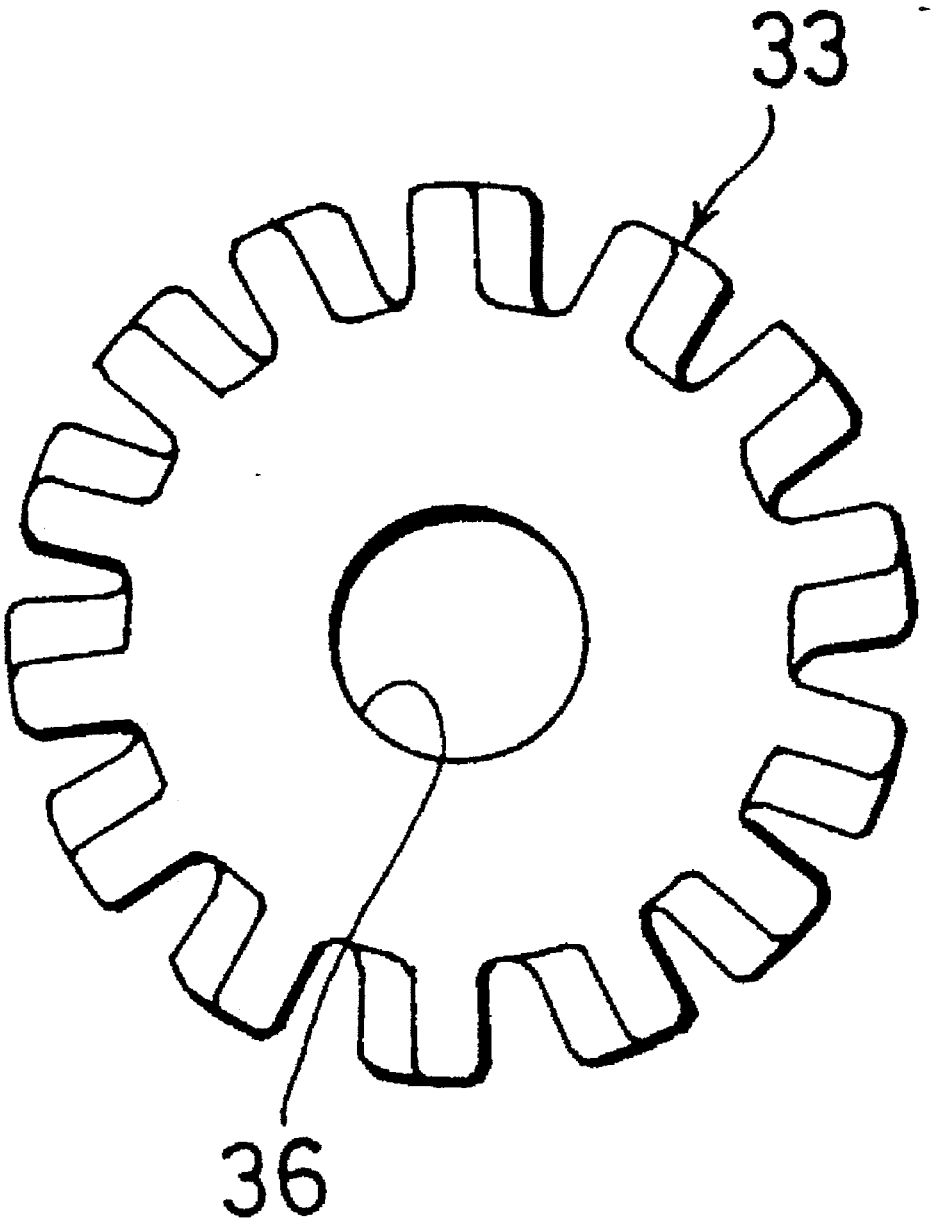
FIG. 2 is a top view to show a holed metal part (helical gear) formed by the device of FIG. 1.

The die 31*a* has a die hole 35 shaped corresponding to a holed metal part 33 which comprises a helical gear as shown in FIG. 2.

And a punch 37 is disposed atop of the die 31*a*.

A counter punch 39 has its upper part fitted with a container hole 31*c* of the container 31*b*.

The counter punch 39 has a through hole 41, whose lower part accommodates a driving pin 43.

And the upper part of the through hole 41 accommodates a small diameter part 47 having a small cross section of a mandrel 45 which is a bar having a substantially circular cross section.

The mandrel 45 has the small diameter part 47 and a large diameter part 49 having a larger cross section. And the large diameter part 49 is inserted into the punch 37.

The mandrel 45 is pushed toward the driving pin 43 by a spring 51 disposed within the punch 37.

The die member 31 is accommodated in a holder 52 so that it can freely make vertical movement.

In this embodiment, the top end of the punch 37 is fixed to an upper holder 73 by a punch holder 71.

The punch 37 has at its center a through hole 37*a*, which accommodates a plug 45*a* of the mandrel 45.

The spring 51 is disposed between the plug 45*a* and the upper holder 73, and a mandrel stopper 75 to restrict the uppermost position of the mandrel 45 is disposed near the top of the through hole 37*a*.

On the other hand, the holder 52 is fixed to a lower holder 77 via a lower plate 79.

The lower plate 79 is provided with a through hole 79*a*, and the lower holder 77 is provided with a hole 77*a* at its upper part.

The lower holder 77 has, at the bottom of its hole 77*a*, a pin driving cylinder 81, to which a hydraulic source 83 is connected.

The pin driving cylinder 81 accommodates a piston 85, and the lower end of the driving pin 43 is fixed to the top of the piston 85.

The hole 77*a* of the lower holder 77 has a second knockout plate 87, and the through hole 79*a* of the lower plate 79 has a first knockout plate 89.

On the top of the first knockout plate 89, a thrust bearing 91 is disposed.

The first knockout plate 89 and the second knockout plate 87 are connected with a first knockout pin 93.

A second knockout pin 95 has its top fixed to the bottom of the second knockout plate 87, and has its bottom made vertically movable under the effect of a knockout device (not shown) disposed below the second knockout pin 95.

A plastic working method for a holed metal part using the above device according to a first embodiment of the present invention will be described below.

As shown in the left part of FIG. 1, a blank 55 with a through hole 53 is loaded into the container hole 31*c*, and the large diameter part 49 of the mandrel 45 is positioned in the through hole 53.

In this state, the punch 37 is lowered so that the lower end of the punch 37 makes contact with the upper end face of the die member 31, and the punch 37 is further lowered so as to contact the lower end of the punch 37 with the top face of the blank 55.

Still further lowering of the punch 37 results in a state shown in the right side of FIG. 1.

Specifically, the blank 55 is compressed between the punch 37 and the counter punch 39, and the blank 55 is plastically flown into the die hole 35.

At this stage, a blank 57 has an underfill E.

Figure 3:
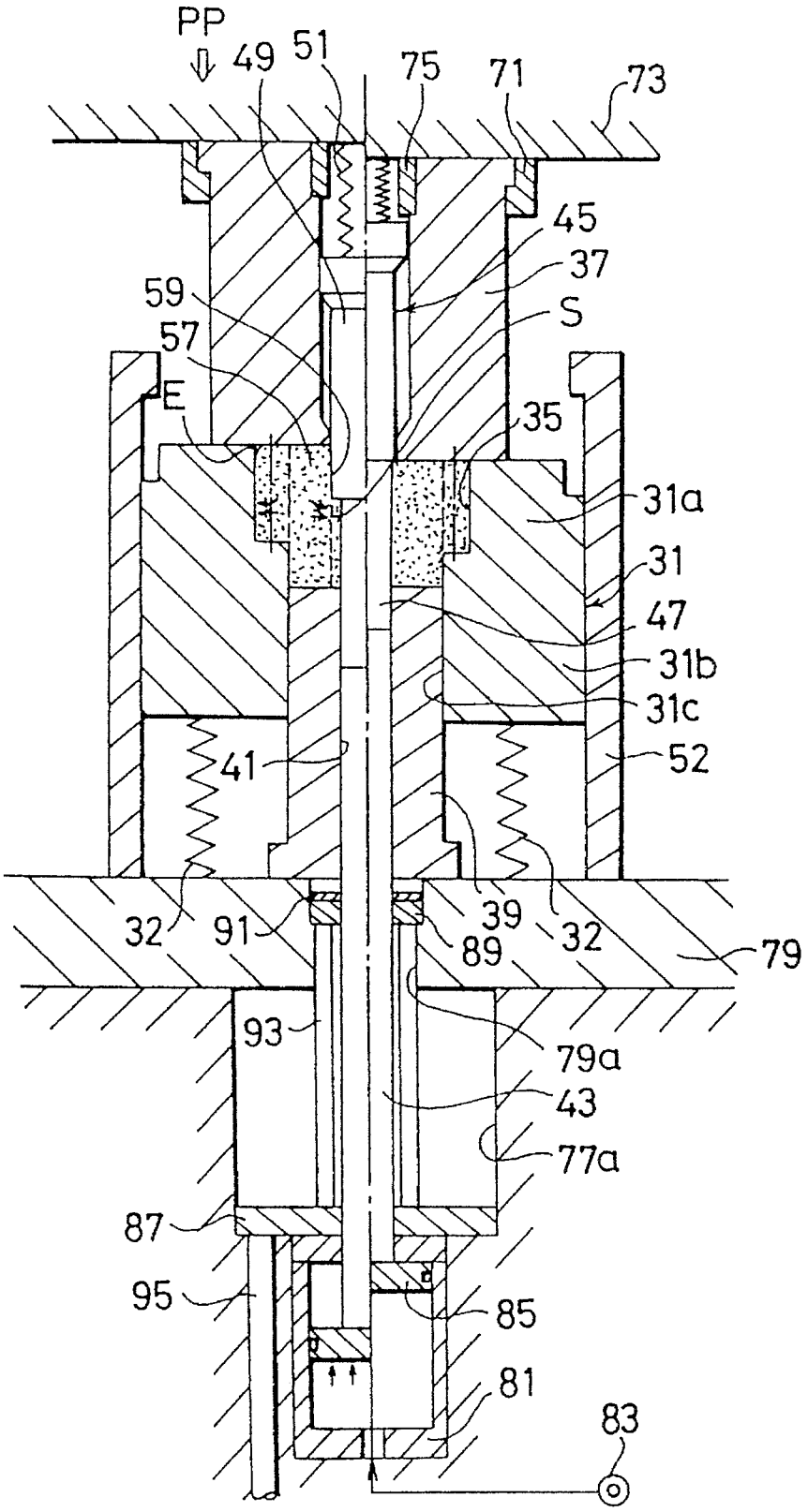
FIG. 3 is a cross sectional view to show the final process by the device of FIG. 1.

Then, as shown in the left part of FIG. 3, with the blank 57 placed under the compressive force PP caused by the punch 37 and the counter punch 39, hydraulic pressure is supplied to the pin driving cylinder 81. This raises a piston 85 with subsequently raising the driving pin 43.

Specifically, the large diameter part 49 of the mandrel in the through hole 59 of the blank 57 is gradually moved in the direction opposite from the small diameter part 47 or upward in the figure, resulting in forming a gap S between the through hole 59 and the small diameter part 47 of the mandrel 45.

In this state, the blank 57 is plastically flown into this gap S and, accordingly the entire blank 57 is caused to flow plastically toward the underfill E of the blank 57 so as to gradually fill the underfill E from the bottom.

Thus, forming is completed when the mandrel 45 is continuously moved and a boundary between the small diameter part 47 and the large diameter part of the mandrel 45 reaches the top end of the through hole 59 of the blank 57, providing a holed metal part 33 without any underfill E. The right part of FIG. 3 shows the formation completed state.

Figure 4:
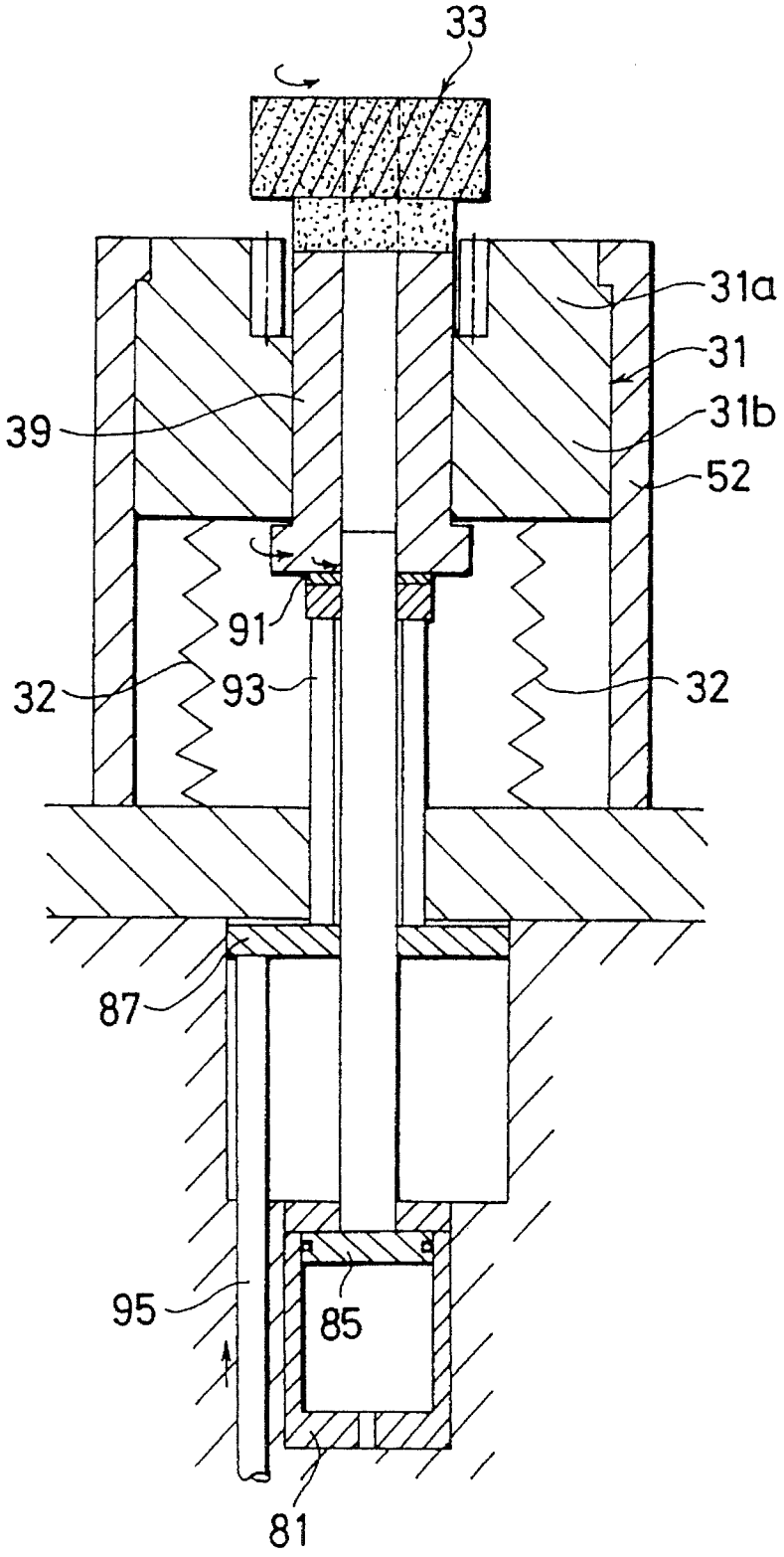
FIG. 4 is a cross sectional view to show the knockout process by the device of FIG. 1.

Then, when the punch 37 is raised, the knockout device (not shown) is driven to raise the second knockout pin 95 as shown in FIG. 4, which raises the first knockout pin 93 via the second knockout plate 87. The thrust bearing 91 supports the counter punch 39, which is now made to be rotatable, rotates along the twisting of the holed metal part 33 so as to knockout the holed metal part 33.

The plastic working method for a holed metal part as described above is characterized in that the punch 37 and the counter punch 39 cause the compressive force to work on the blank 57. In this process, the large diameter part 49 of the mandrel 45 is gradually pulled out to form the gap S between the small diameter part 47 of the mandrel 45 and the through hole 59, and the blank 57 gradually makes plastic flow into the gap S, and accordingly the blank 57 is entirely made to flow plastically toward the underfill E to gradually fill it from the bottom. This enables to provide a holed metal part without any defect such as an underfill.

Second Embodiment

Figure 5:
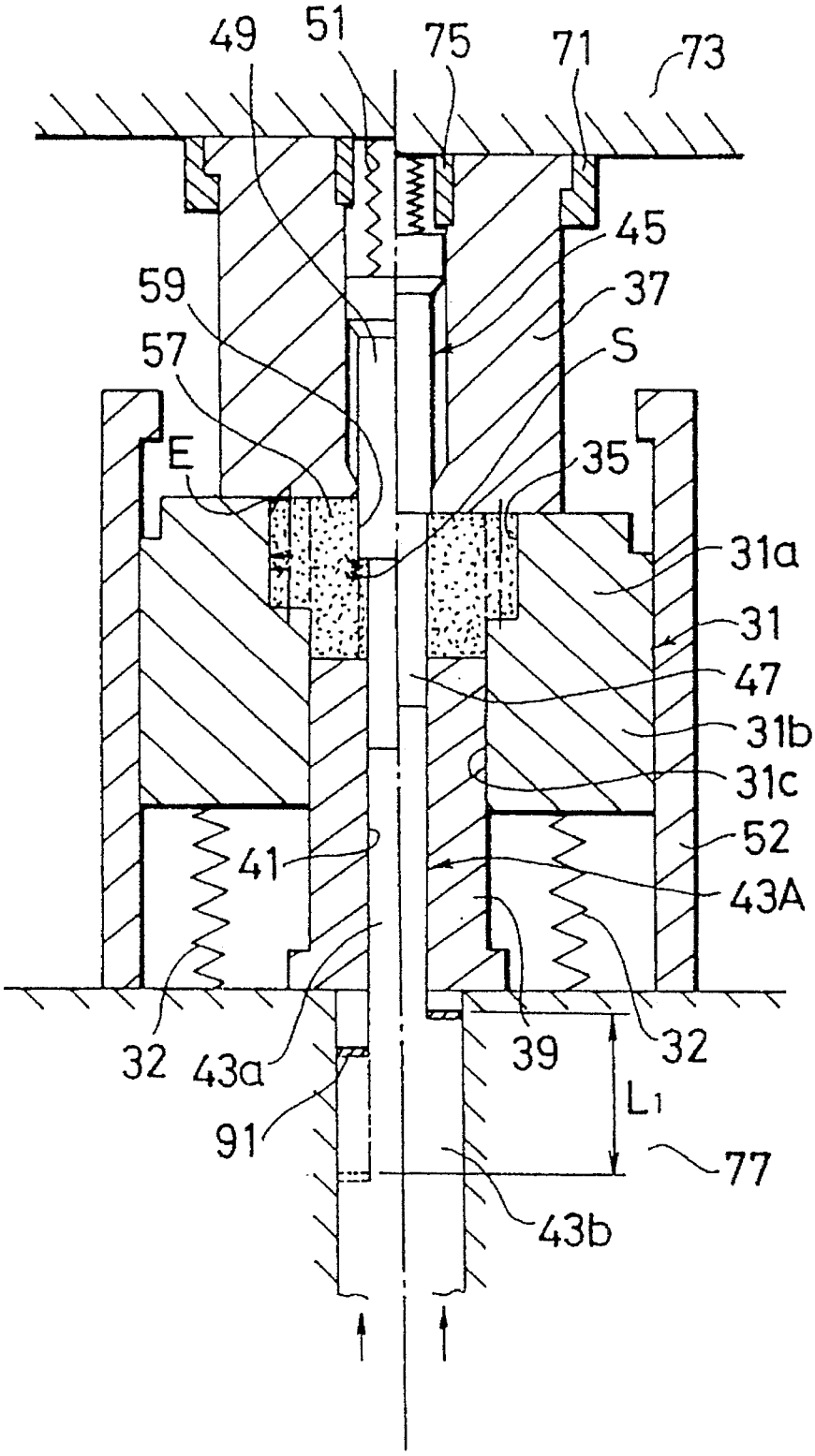
FIG. 5 is a cross sectional view to show a plastic working device used in a second embodiment of the plastic working method for a holed metal part according to this invention.

FIG. 5 shows a plastic working device used in a second embodiment of the plastic working method for a holed metal part according to this invention.

This device is provided with a mandrel driving part 34*a* having the same diameter as the small diameter 47 of the mandrel 45 at the top of the driving pin 43A, and a knockout 43*b* having a larger diameter than the mandrel driving part 43*a* at the bottom.

On the top of the knockout 43*b*, a thrust bearing 91 is disposed.

The plastic working method using this device will be described. Referring to FIG. 5, a knockout device (not shown) moves the driving pin 43A upward, causing the small diameter part 47 of the mandrel 45 to be gradually inserted into the through hole 59 for moving the mandrel 45.

Figure 6:
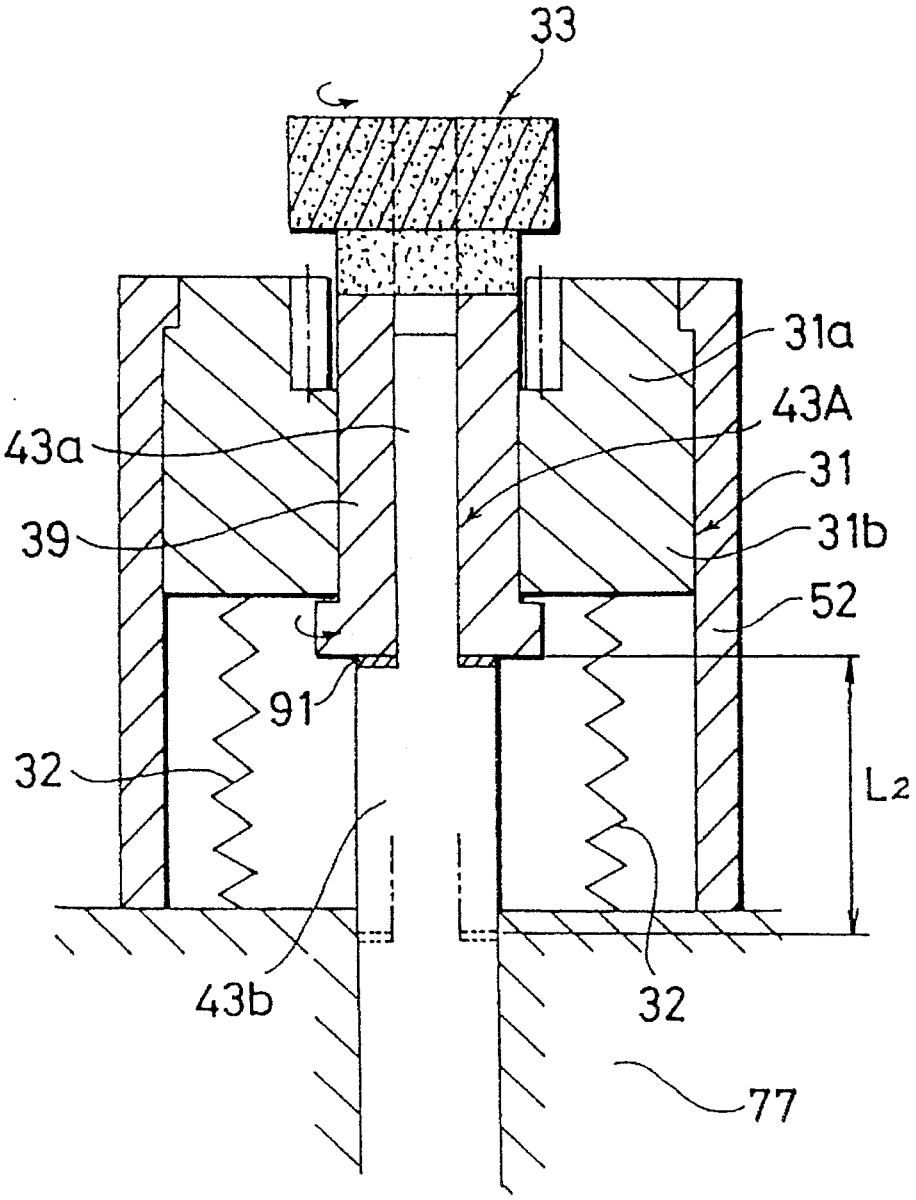
FIG. 6 is a cross sectional view of the knockout process by the device of FIG. 5.

Referring now to FIG. 6, upon completion of forming, the knockout device (not shown) further moves the driving pin 43A upward so that the thrust bearing 91 makes contact with the counter punch 39, making it rotatable. The counter punch 39 now rotatably supported by the thrust bearing 91 rotates along the twisting on the holed member 33 and is knocked out.

Third Embodiment

Figure 7:
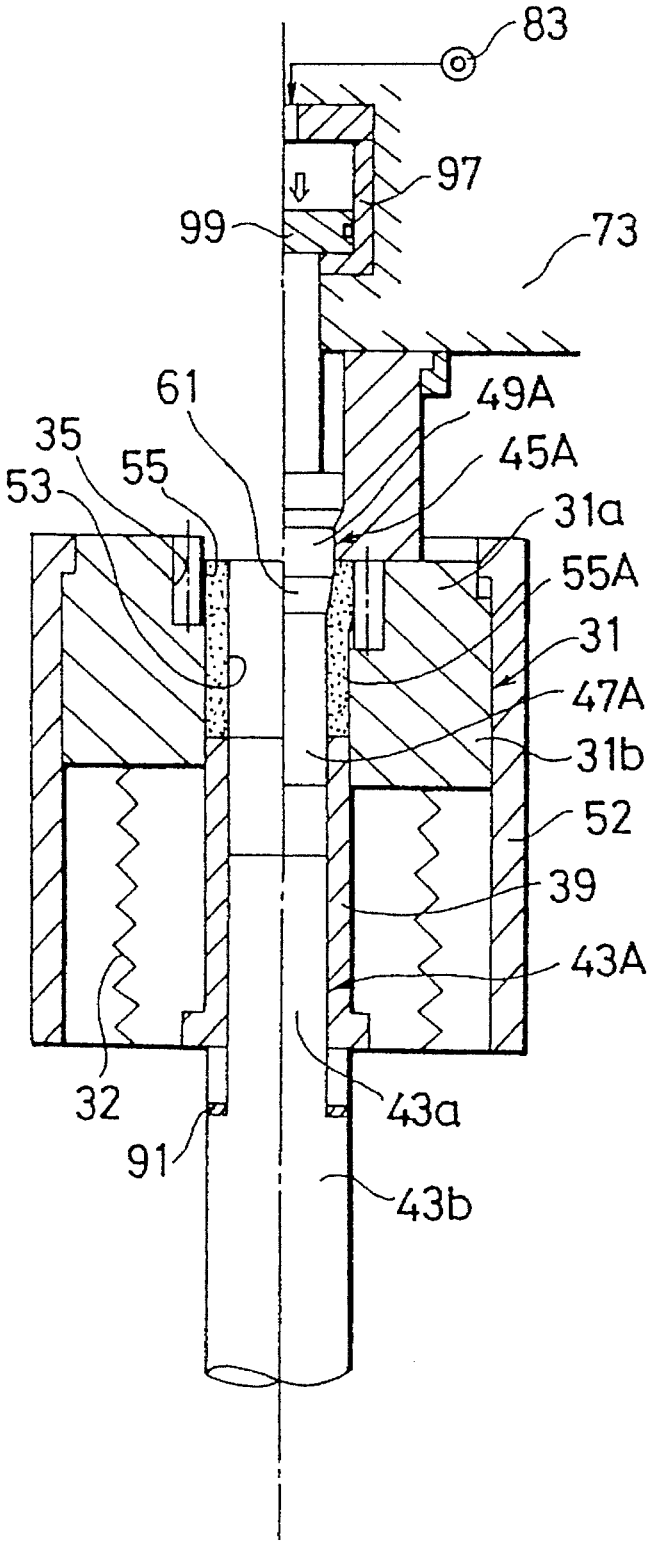
FIG. 7 is a cross sectional view to show a plastic working device used in a third embodiment of the plastic working method for a holed metal part according to this invention.

FIG. 7 shows a plastic working device used in a third embodiment of this invention.

This device is provided with a taper part 61, which is a diameter enlarging part for enlarging the through hole 53 of the blank 55, between a large diameter part 49A and a small diameter part 47A of a mandrel 45A.

The upper holder 73 is provided with a mandrel press fitting cylinder 97, which has its piston 99 connected with the upper end of the mandrel 45A.

In this embodiment, a ring-shaped material 55 is loaded into the container hole 31*c* as shown in the left part of FIG. 7.

The inner diameter of the through hole 53 is almost equal to or slightly larger than the outer diameter of the small diameter part 47A of the mandrel 45A, and is sufficiently smaller than the outer diameter of the large diameter part 49A.

With the mandrel 45A pushed toward the container 31*b* by the piston 99 of the mandrel press fitting cylinder 97, the punch 37 is lowered. This inserts the small diameter part 47A of the mandrel 45A into the through hole 53 of the blank 55. Then, the taper part 61 and the large diameter part 49A of the mandrel 45A are continuously press fit into the through hole 53, which enlarges the opening at the blank 55 on the side of the punch 37.

Figure 8:
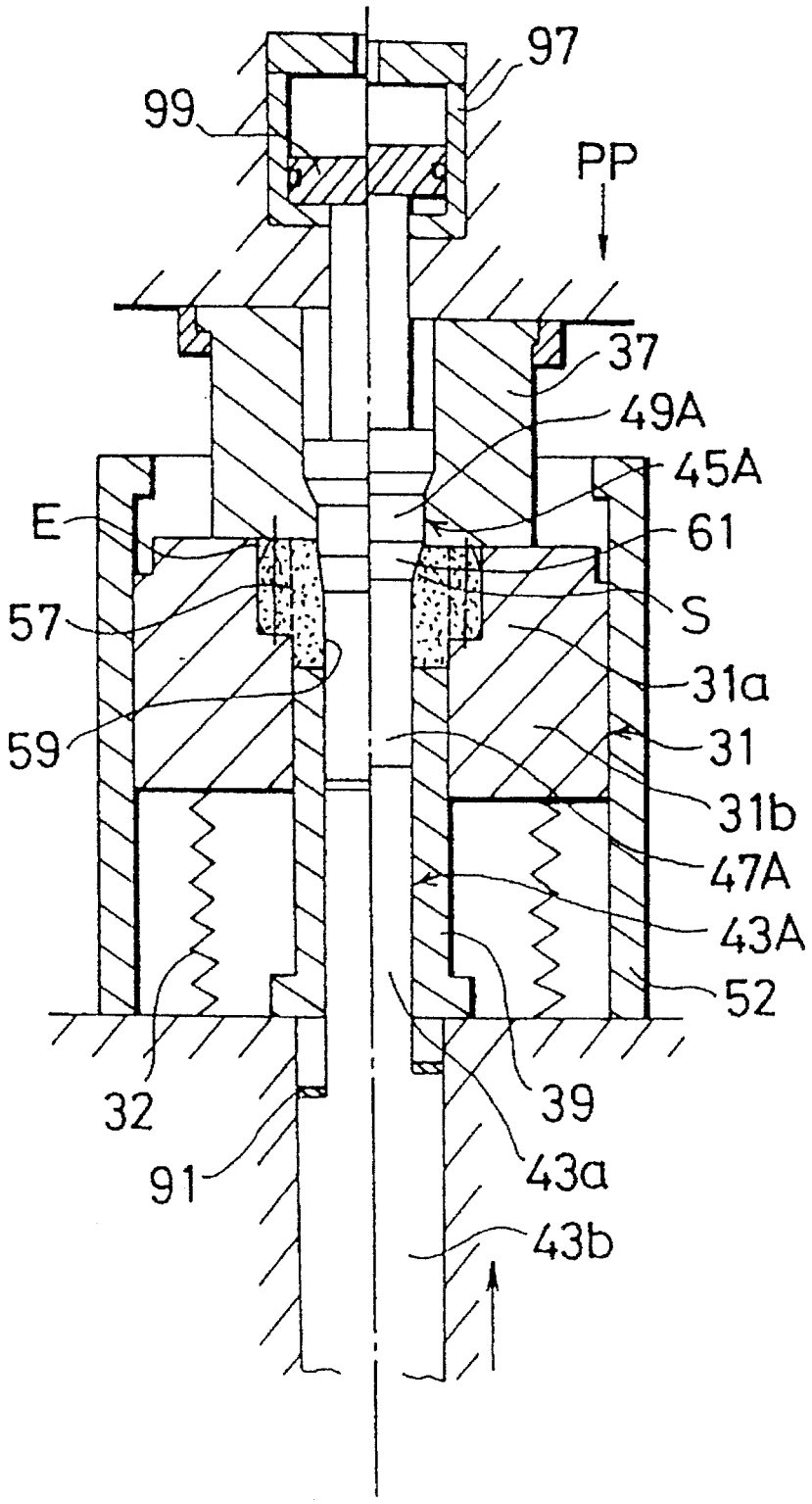
FIG. 8 is a cross sectional view of the final process by the device of FIG. 7.

When the punch 37 is further lowered, as shown in the left part of FIG. 8, a blank 55A is compressed by the punch 37 and the counter punch 39. Then, the blank 57 is obtained with the die hole 35 filled with the blank 55A.

The obtained blank 57 has an underfill E.

Next, as shown in FIG. 8, a pressure is applied to the punch 37 so as to apply a compressive force PP to the blank 57.

In this state, when the driving pin 43 is gradually raised up, the large diameter part 49A and the taper part 61 of the mandrel 45A are pulled out of the through hole 59 of the blank 57, forming a gap S between the through hole 59 and the small diameter part 47A of the mandrel 45A.

And, the blank 57 gradually makes plastic flow into the gap S.

Due to this plastic flow, the blank 57 readily makes plastic flow partly, and also makes plastic flow to the underfill E, which is gradually filled from the bottom.

When the driving pin 43A is gradually rising up, the mandrel 45A is moved upward even when the mandrel 45A is under the downward pushing force, if the rising force of the driving pin 43A is higher than the downward pushing pressure. However, the upward movement of the mandrel 45A can be made smoother if the downward pushing force on the mandrel is eliminated.

If the downward pushing force on the mandrel 45A is eliminated, the mandrel 45A may rise up without any operation due to downward compressive force of the punch 37 pressing the taper part 61, depending on the shape and friction coefficient. In this case, the driving pin 43A is not always required to raise the mandrel 45A.

Figure 9:
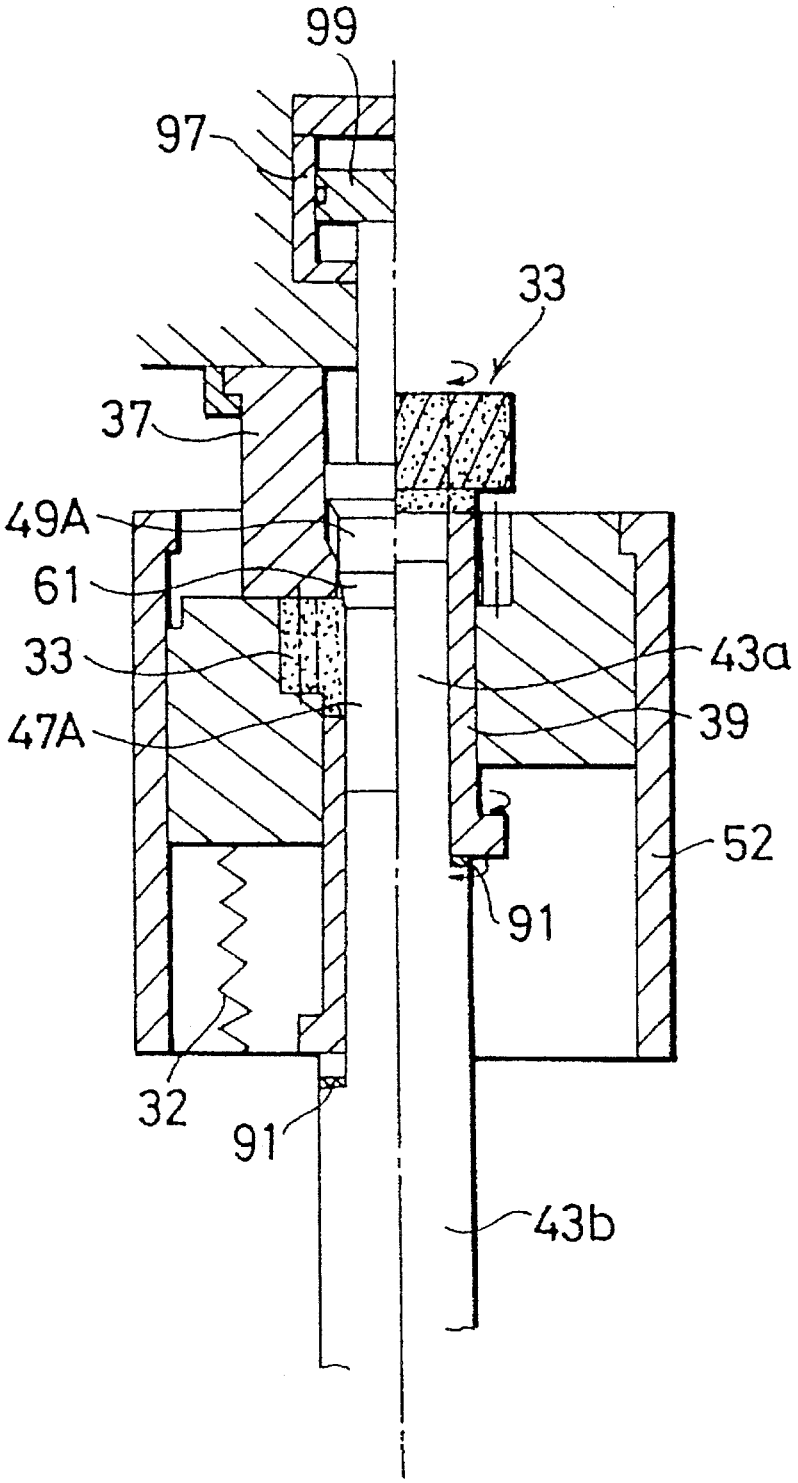
FIG. 9 is a cross sectional view of the knockout process by the device of FIG. 7.

The mandrel 45A rises up, and as shown in the left part of FIG. 9, forming is completed when a boundary between the small diameter part 47A and the taper part 61 reaches the top end of the through hole 59, providing a holed metal part without any underfill E.

Then, the punch 37 and the counter punch 39 are raised up so that the holed metal part 33 shaped to a predetermined shape can be taken out.

Thus, it is understood that the third embodiment can provide substantially the same result as the first embodiment.

Though the taper part 61 and the large diameter part 49A are inserted into the blank 55 in the above embodiment, the present invention is not limited to such an operation; for example, insertion of the taper part 61 alone may be sufficient.

Besides, the taper part 61 may have a curved shape such as an arc.

Fourth Embodiment

Figure 10:
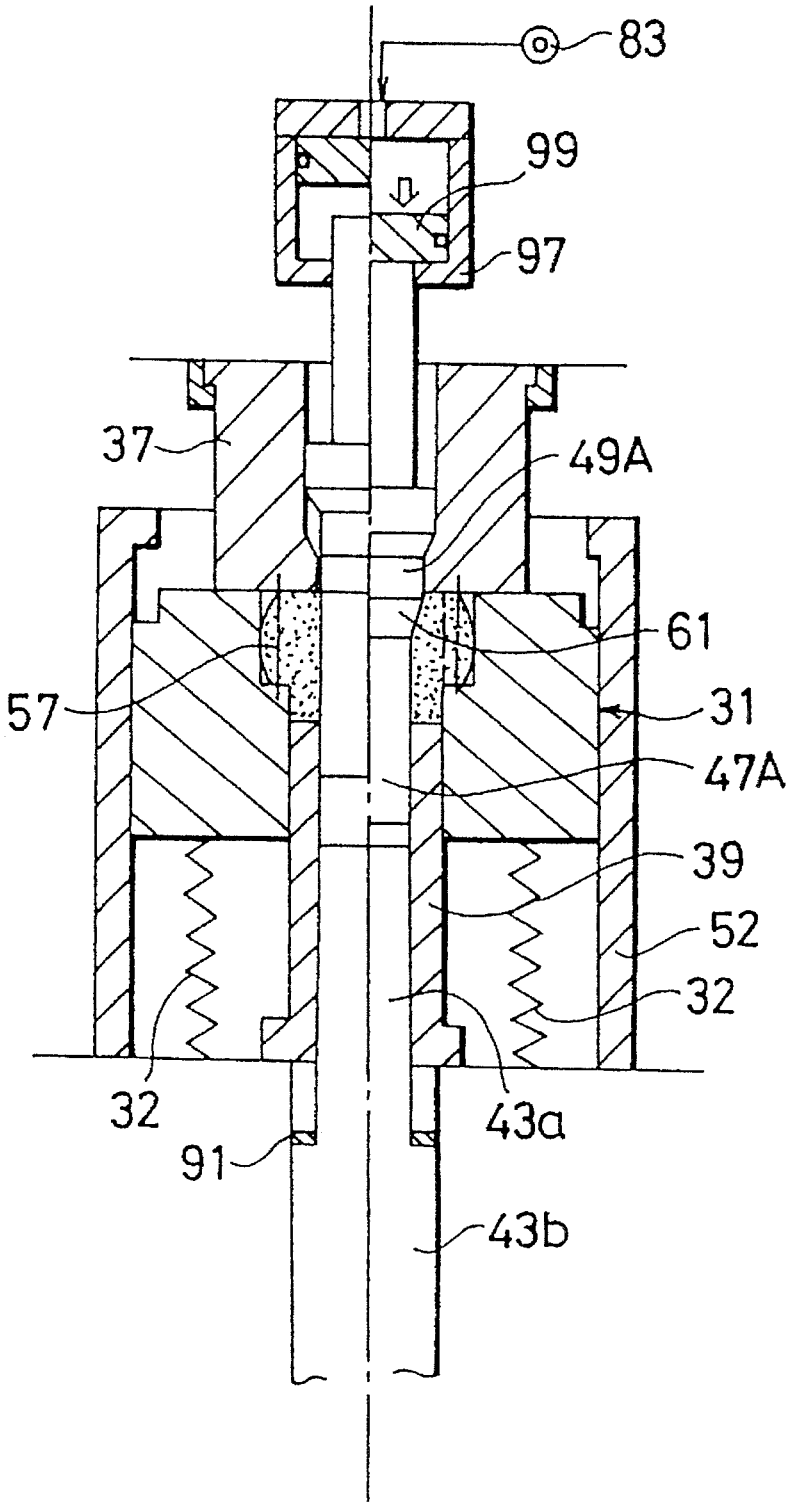
FIG. 10 is a cross sectional view of a plastic working device used in a fourth embodiment of the plastic working method for a holed metal part according to this invention.

FIG. 10 shows the essential part of a fourth embodiment of this invention.

In the same way as in the left part of FIG. 7, a ring-shaped material 55B is loaded into the die hole 35 and the container 31*c* communicating to each other.

Then, the punch 37 is lowered with the small diameter part 47A of the mandrel 45A inserted into the through hole 53A of the blank 55B and, as shown in the left part of FIG. 10, the punch 37 and the counter punch 39 compress the blank 55B, which is plastically flown into the die 31*a*.

Next, the mandrel 45A is pushed toward the container 31*b* by the piston 99 of the mandrel press fitting cylinder 97, causing the taper part 61 and the large diameter part 49A of the mandrel 45A to be subsequently press fitted into the through hole 53A. This results in an enlarged opening at the blank 55B on the side of the punch 37 as shown in the right part of FIG. 10, and a blank 55C is obtained.

In the same way as shown in the right part of FIG. 8 and the left part of FIG. 9, the holed metal part 33 formed to a desired shape can be obtained.

Fifth Embodiment

Figure 11:
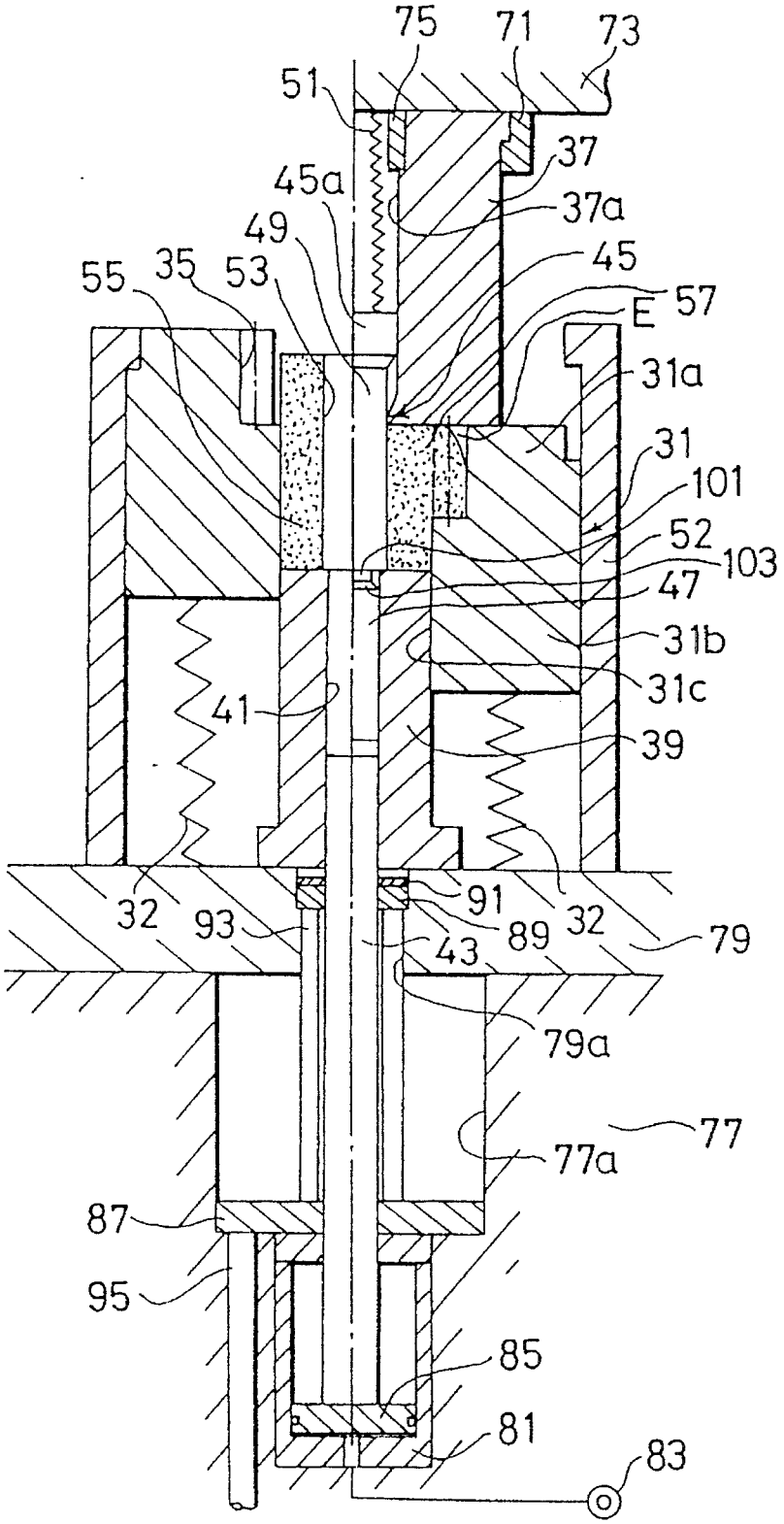
FIG. 11 is a cross sectional view of a plastic working device used in a fifth embodiment of the plastic working method for a holed metal part according to this invention.

FIG. 11 shows a plastic working device used in a fifth embodiment of this invention.

A relief 101 having a smaller diameter than the small diameter part 47 is provided between the large diameter part 49 and the small diameter part 47 of the mandrel 45.

A taper shaped approach 103 is formed under the relief 101.

This working method is conducted substantially in the same manner as in the first embodiment.

Figure 12:
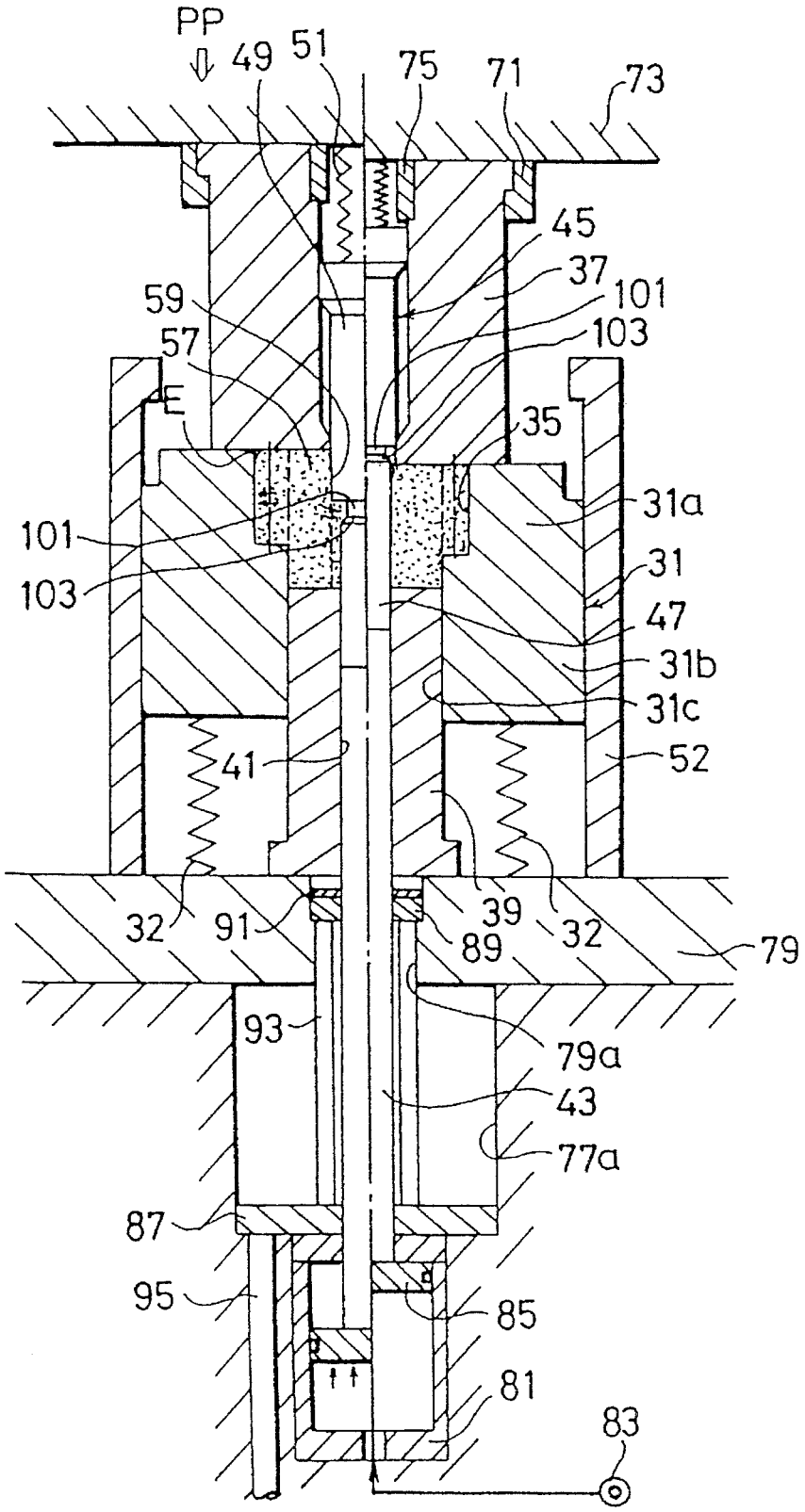
FIG. 12 is a cross sectional view to show the final process by the device of FIG. 11.

With the mandrel 45 moving as shown in the left part of FIG. 12, the compressive force working on the blank 57 causes the blank 57 to flow into the relief 101 first and then to be ironed by the approach 103 and the small diameter part 47.

This realizes highly accurate finishing of the hole 36 in the holed metal part 33.

Figure 13:
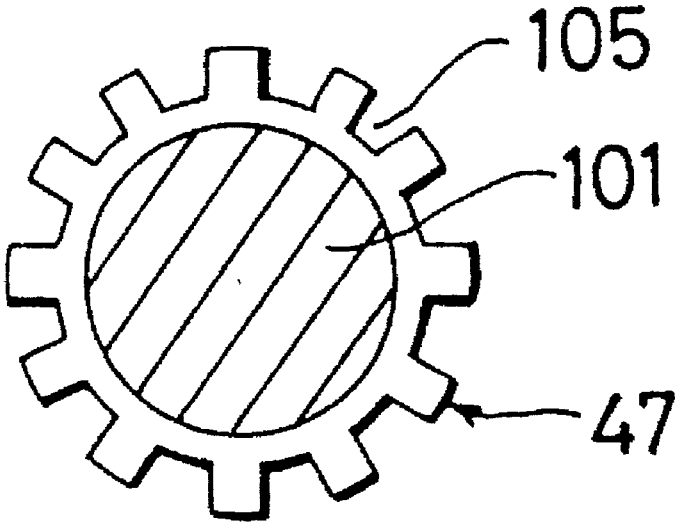
FIG. 13 is a cross sectional view to show a small diameter part where grooves are formed, which can be used for the device of FIG. 11.

If grooves 105 are shaped in axial direction on the outer circumference of the small diameter part 47 under the relief 101 of the mandrel 45 as shown in FIG. 13 so as to make a cross sectional shape such as the one for a spline, highly accurate finishing of a spline hole can be realized.

Sixth Embodiment

Figure 14:
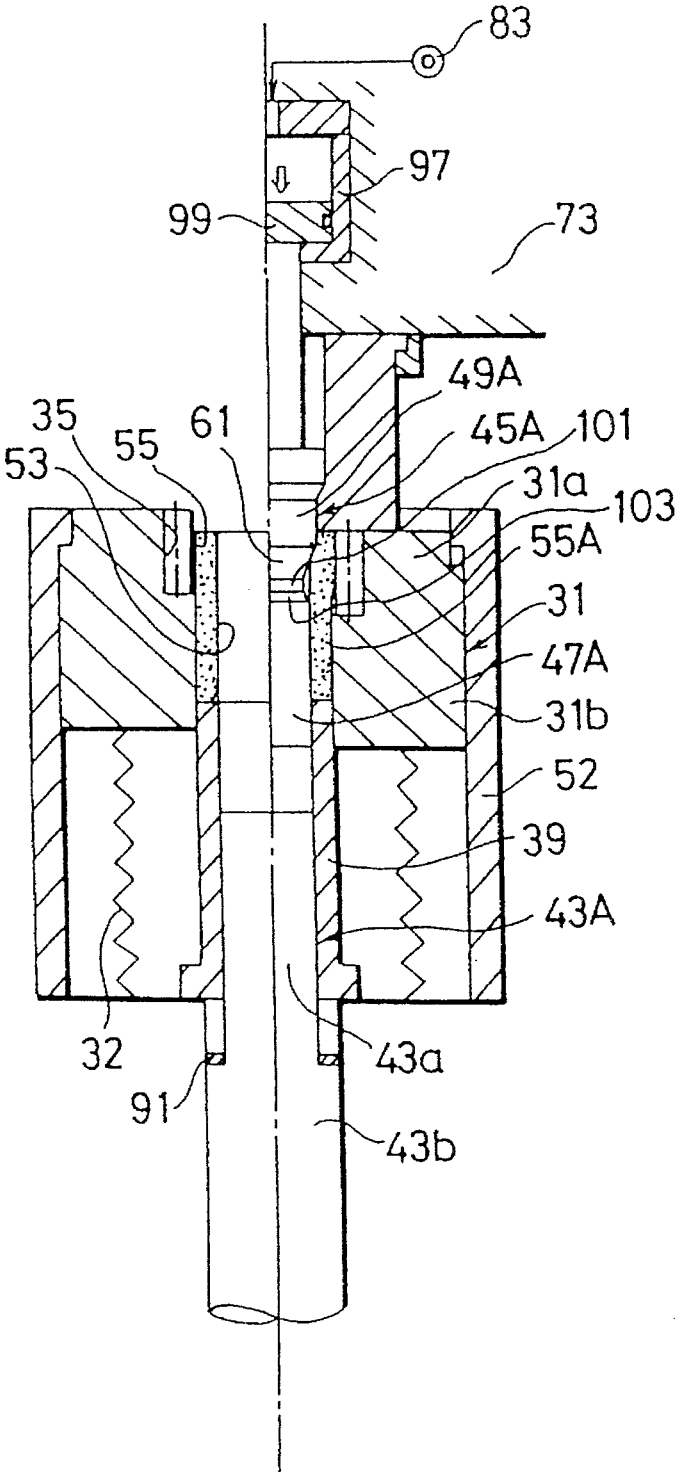
FIG. 14 is a cross sectional view to show a plastic working device used in a sixth embodiment of the plastic working method for a holed metal part according to this invention.

FIG. 14 shows a plastic working device used in a sixth embodiment of this invention.

A relief 101 having a smaller diameter than the small diameter part 47A is provided between the taper part 61 and the small diameter part 47A of the mandrel 45A.

A taper shaped approach 103 is formed under the relief 101.

Figure 15:
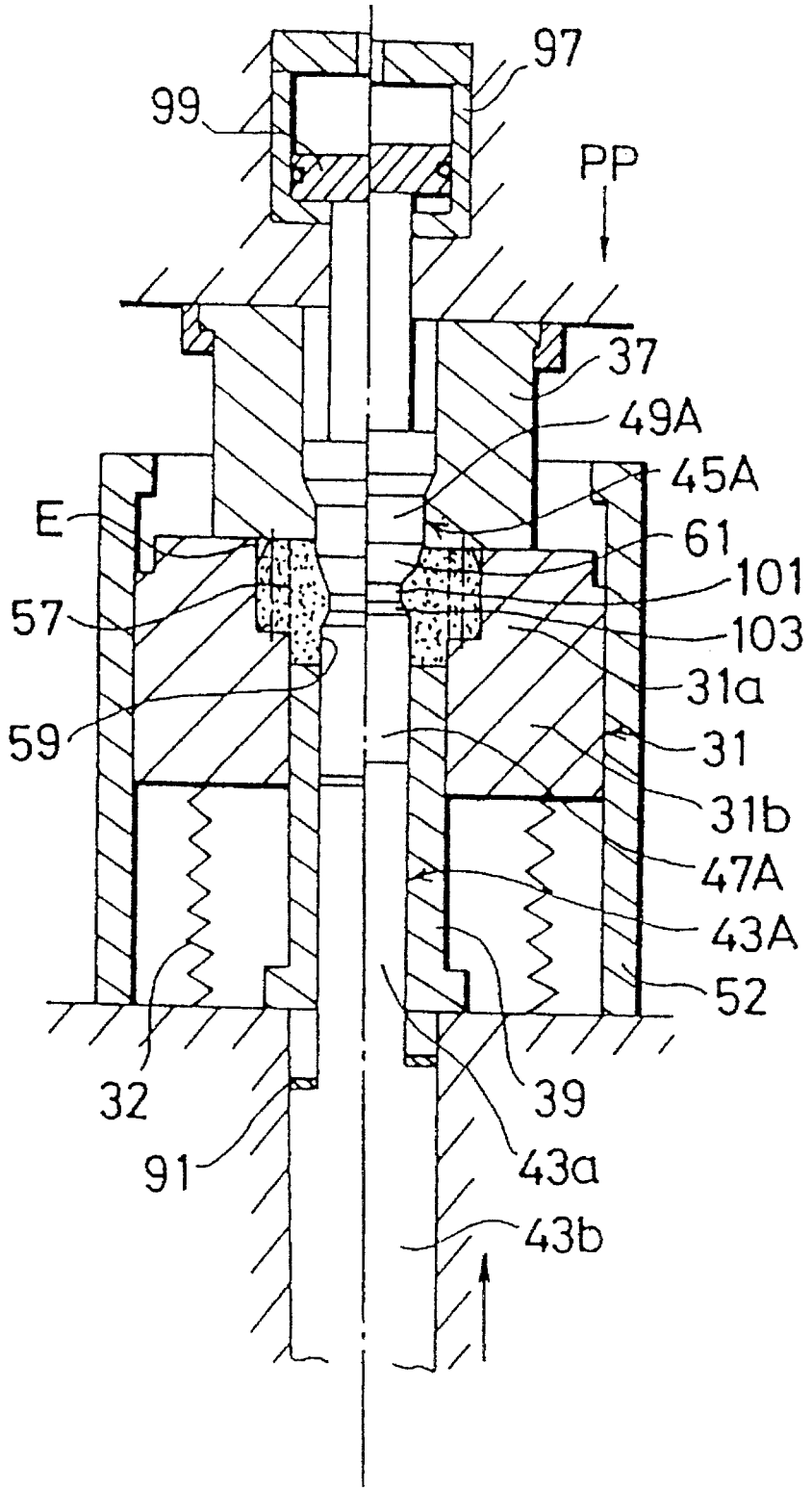
FIG. 15 is a cross sectional view to show the final process by the device of FIG. 14.
Figure 16:
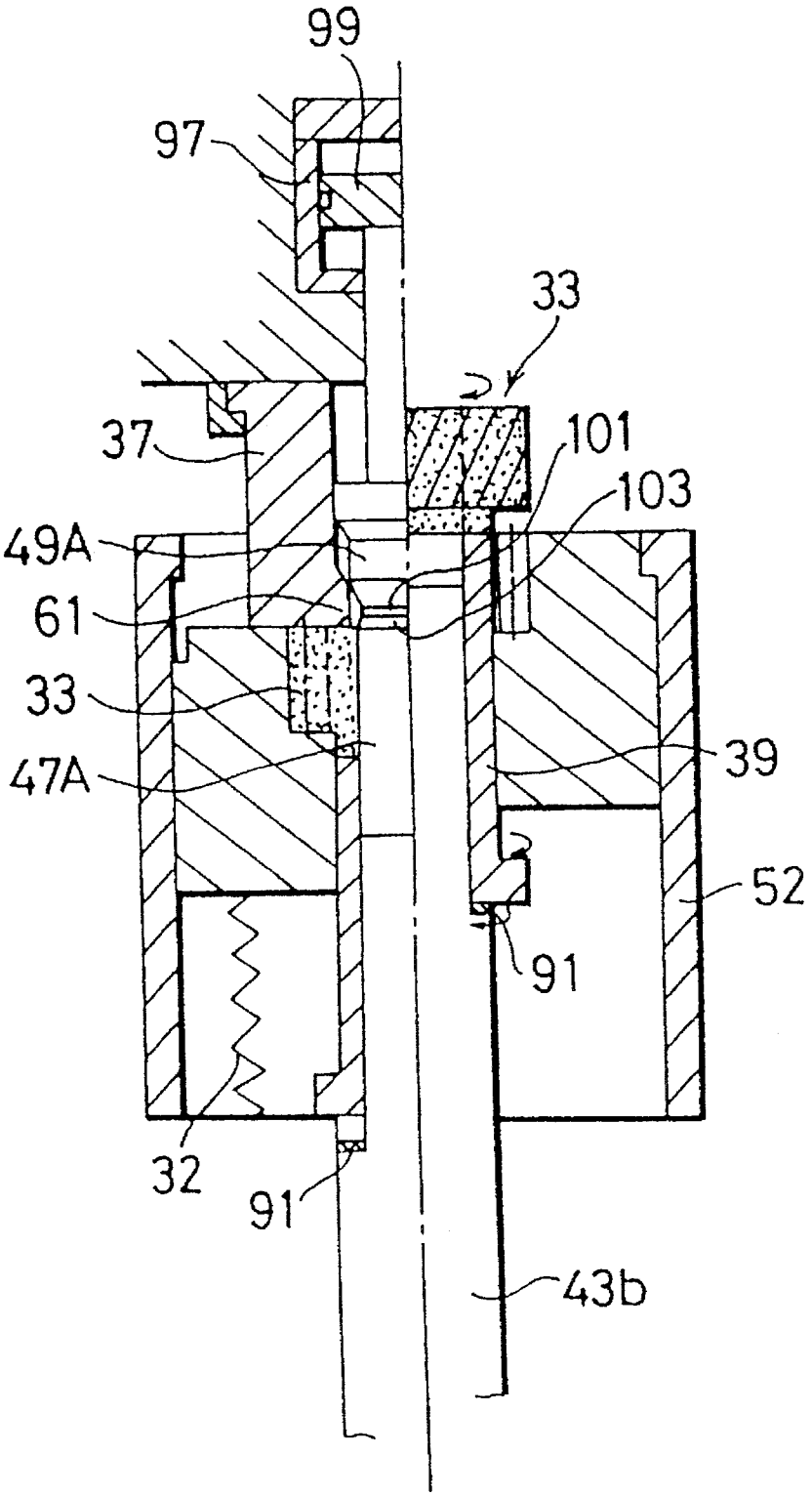
FIG. 16 is a cross sectional view to show the knockout process by the device of FIG. 14.

This working method is conducted substantially in the same manner as in the third embodiment as shown in FIG. 14 through FIG. 16.

In this embodiment, with the mandrel 45A moving as shown in the right part of FIG. 15, the compressive force causes the blank 57 to flow into the relief 101 first and then to be ironed by the small diameter part 47A. This realizes highly accurate finishing of the hole 36.

Figure 17:
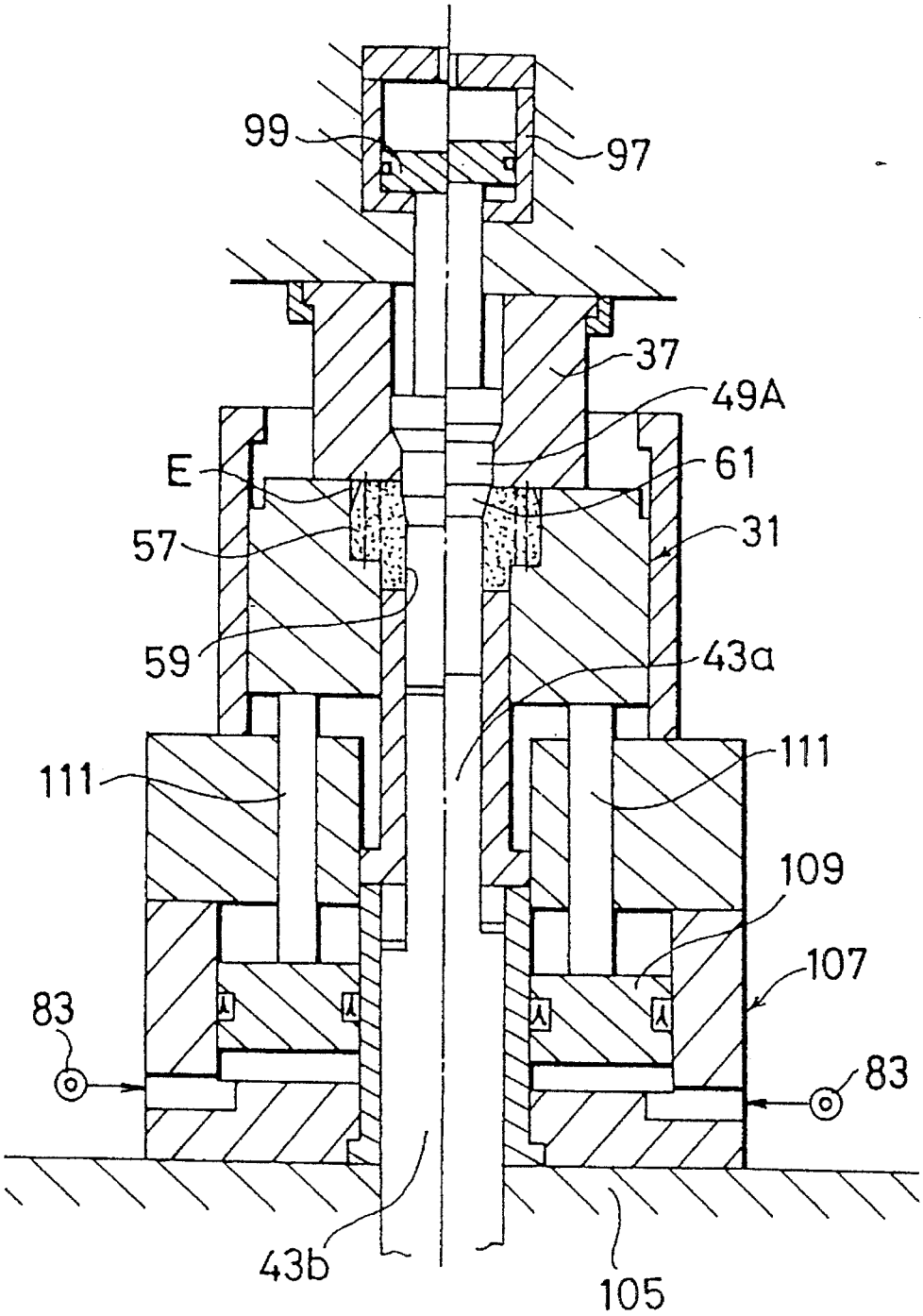
FIG. 17 is a cross sectional view to show a device to energize the die member upward using a pushing force generating cylinder.

Though the die member 31 is pushed toward the punch 37 by the energizing member 32 comprising a spring in the above embodiments, this invention is not limited to such a configuration. For example, the die member 31 may be pushed upward by a piston rod 111 connected with a piston 109 of a cylinder disposed on the top of a lower holder 105, as shown in FIG. 17.

Figure 18:
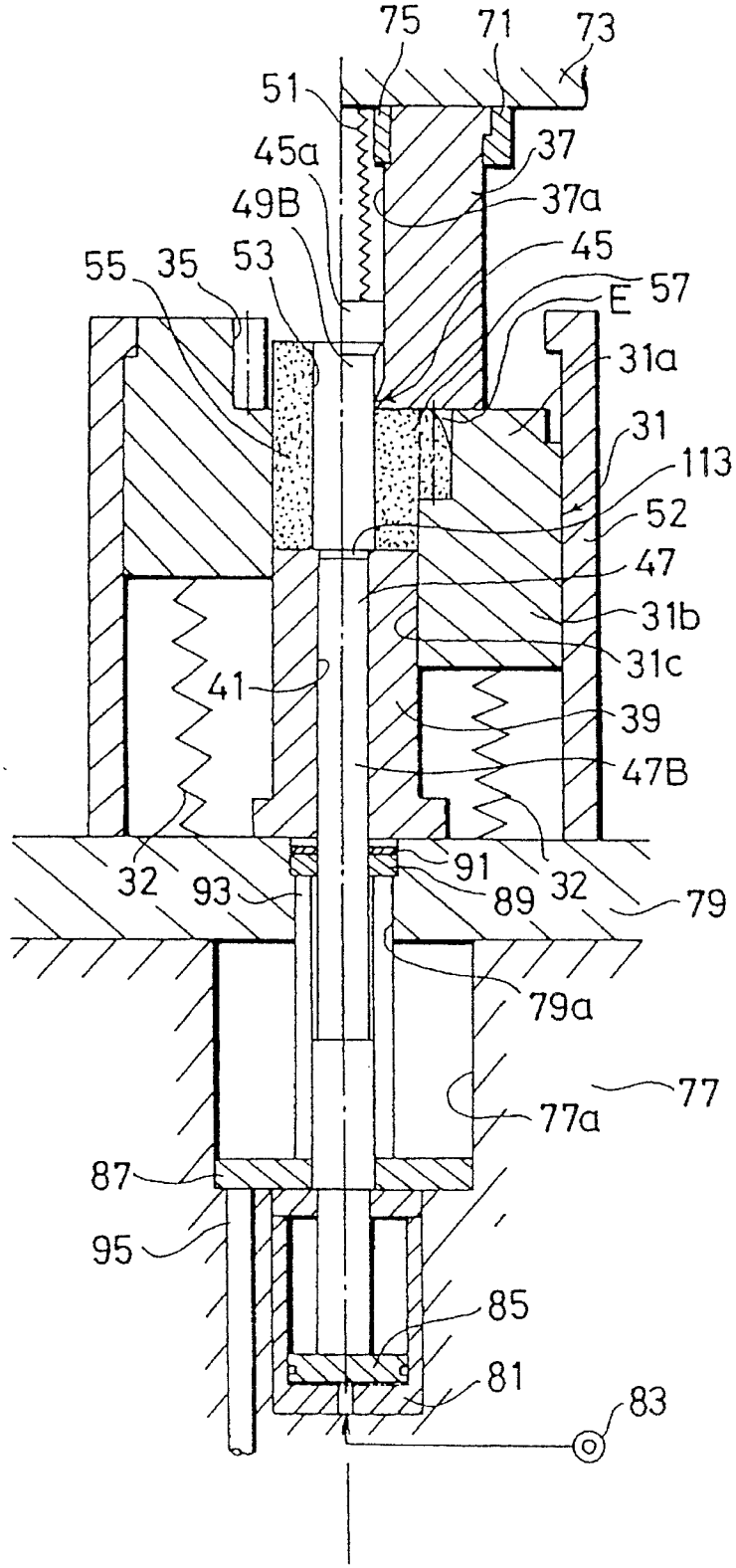
FIG. 18 is a cross sectional view to show a device with a large diameter part and a small diameter part separated for a mandrel.
Figure 19:
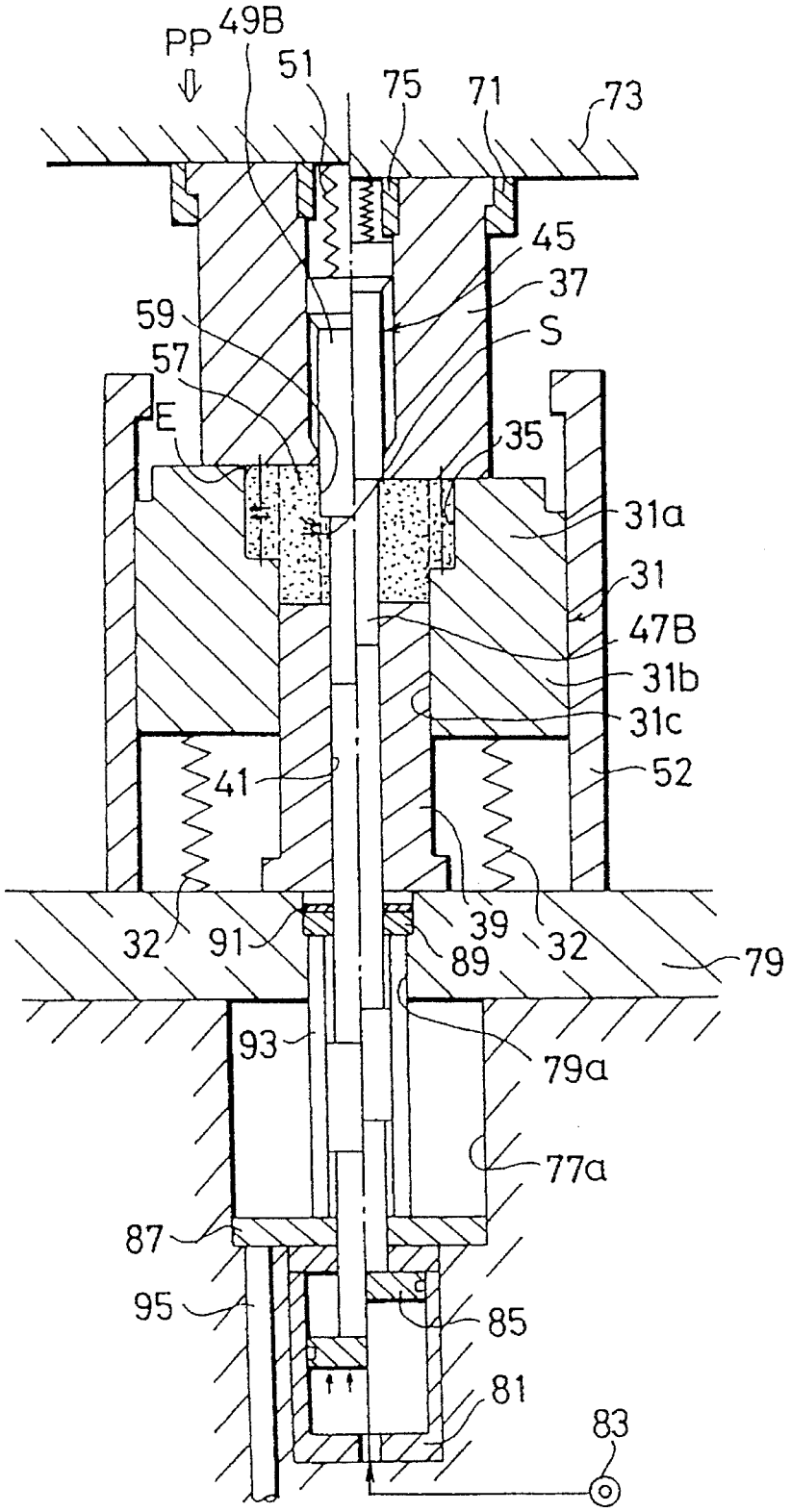
FIG. 19 is a cross sectional view to show the final process by the device of FIG. 18.

Although the large diameter part 49 and the small diameter part 47 of the mandrel 45 are formed as a one-piece unit, for example the large diameter part 49B and the small diameter part 47B may be separated at their boundary plane 113 as shown in FIG. 18 and FIG. 19.

Figure 20:
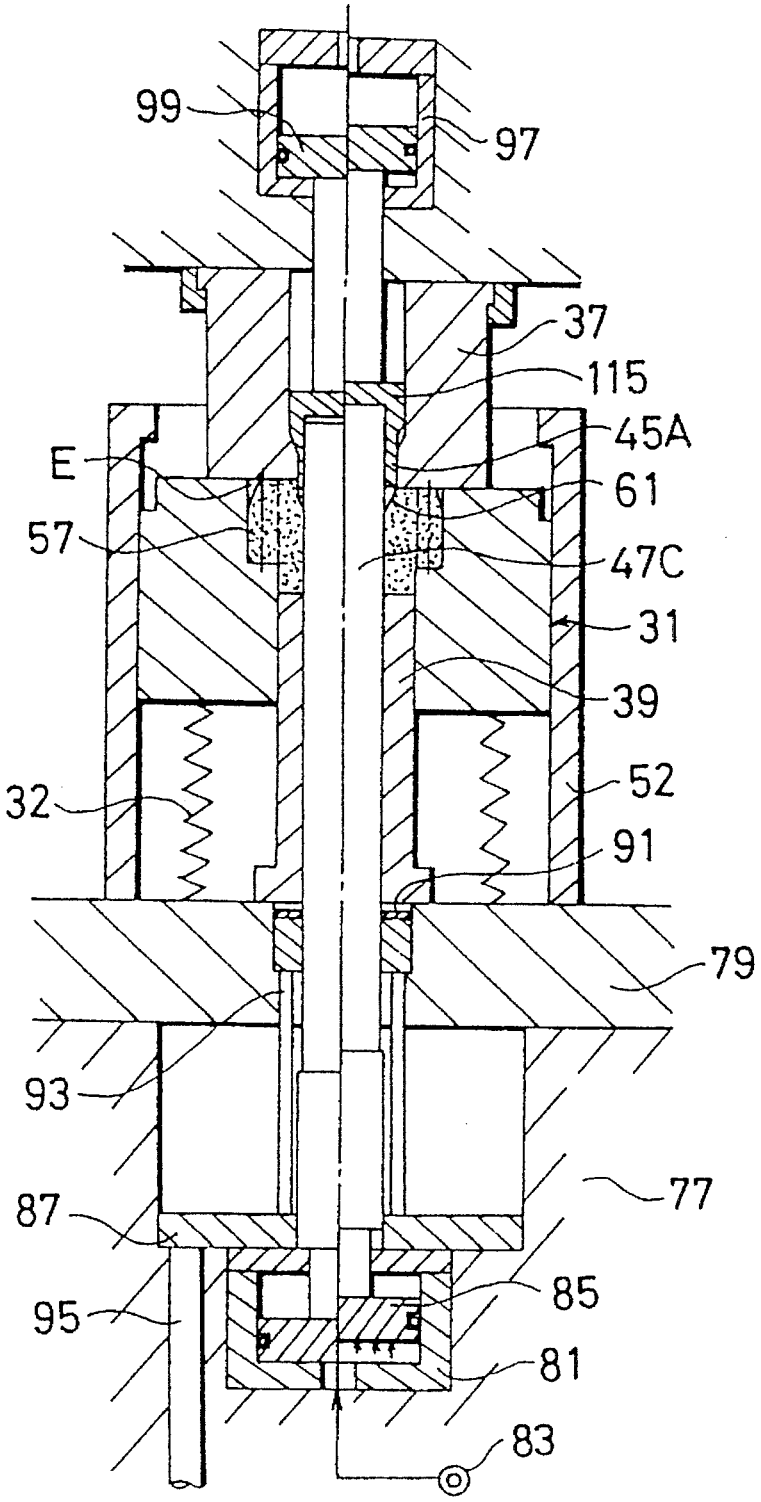
FIG. 20 is a cross sectional view to show a device comprising a mandrel provided with a taper part and a small diameter part as separate units.

Further, as to the formation of the taper part 61 and the small diameter part 47A to the mandrel 45A, for example, as shown in FIG. 20, the taper part 61 and the large diameter part 45A may be formed by a separated member 115, and the upper end of the small diameter part 47C may be inserted into the separated member 115.

Figure 21:
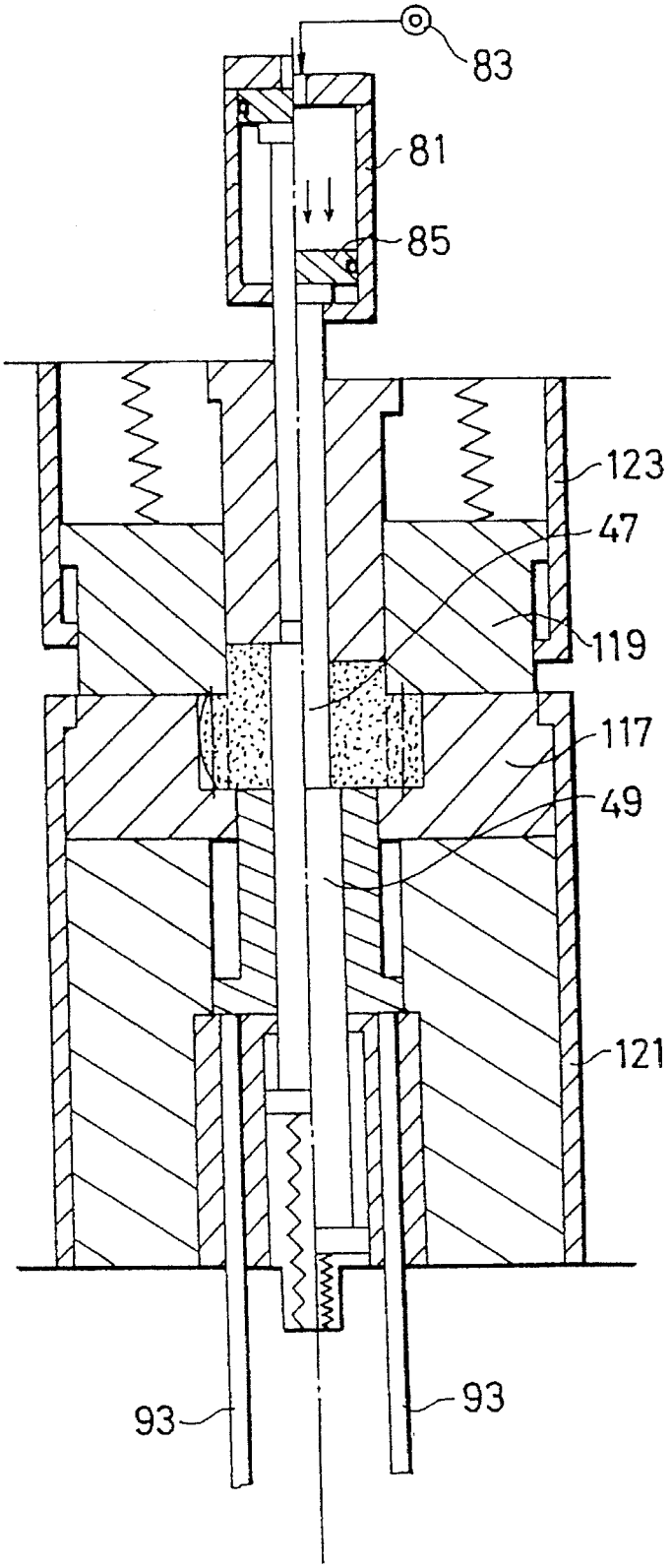
FIG. 21 is a cross sectional view to show a device provided with a die and a container as separate units.

In addition, as shown in FIG. 21, a die 117 and a container 119 may be formed as separated units, and the die 117 may be disposed at a lower holder 121 and the container 119 at an upper holder 123.

Figure 22:
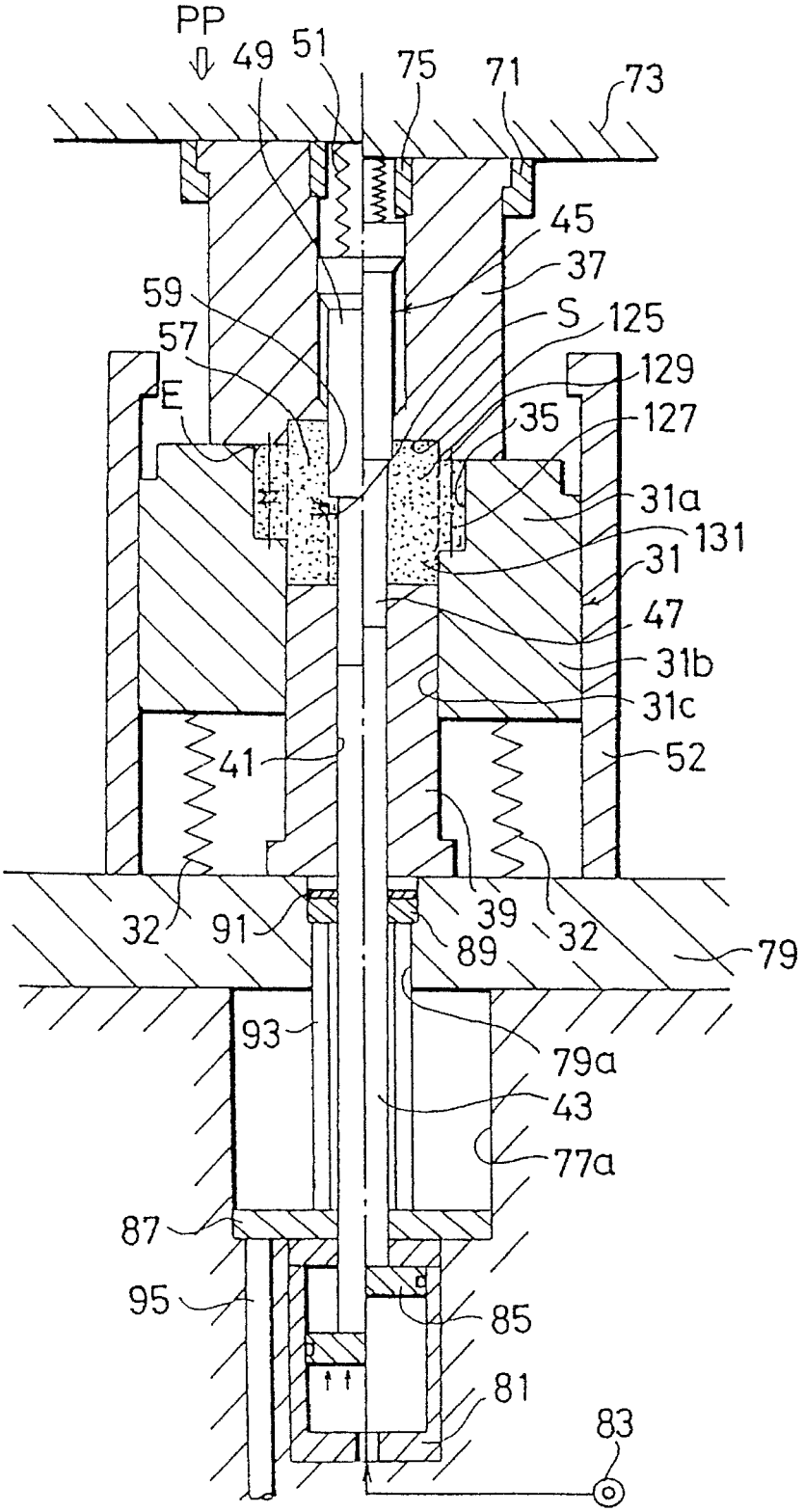
FIG. 22 is a cross sectional view to show a device which forms a holed metal part by bosses on both sides of the teeth.

Although it is described that a boss is formed on only one end of the teeth, for example, as shown in FIG. 22, a recess 125 may be formed at the end of the punch 37 to form bosses 129 and 131 on the both ends of the teeth part 127.

Although a helical gear is used to describe the above embodiments, this invention is not limited to such embodiments. It is understood that the holed metal part may be a cylinder, a triangle pole, a square pole, a hexagonal pole or a spur gear or a bevel gear.

Further, the outer periphery of the mandrel is not limited to a circle but also may be a square, a hexagon or spline-shaped.

And, forming may be done under lower stress by heating the die member for smoother conditions.

Figure 23:
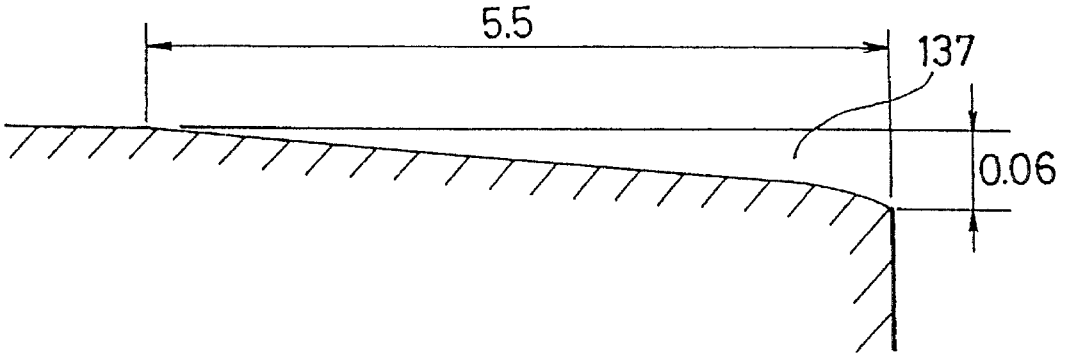
FIG. 23 is an explanatory view to illustrate the underfill of a helical gear formed according to the first embodiment.
Figure 24:
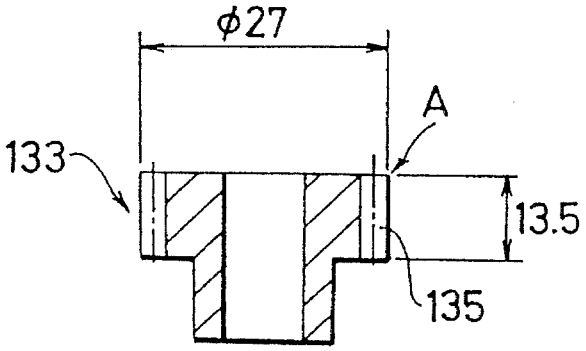
FIG. 24 is a cross sectional view of a shape of the helical gear of FIG. 23.

FIG. 23 shows an underfill at a tooth top (A in FIG. 24) when a helical gear 133 having one module, 23 teeth and a pitch cylinder helix angle of 20 degrees as shown in FIG. 24 is formed under an average stress of 120 kg/mm 2 at room temperature according to the first embodiment.

An underfill 137 formed is substantially a triangle having a radial dimension of 5.5 mm and an axial dimension of 0.06 mm.

Figure 25:
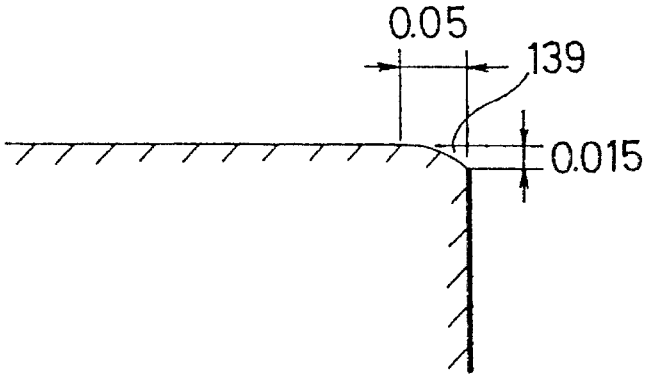
FIG. 25 is an explanatory view to illustrate the underfill of a helical gear formed according to the first embodiment by heating the die member.
Figure 26:
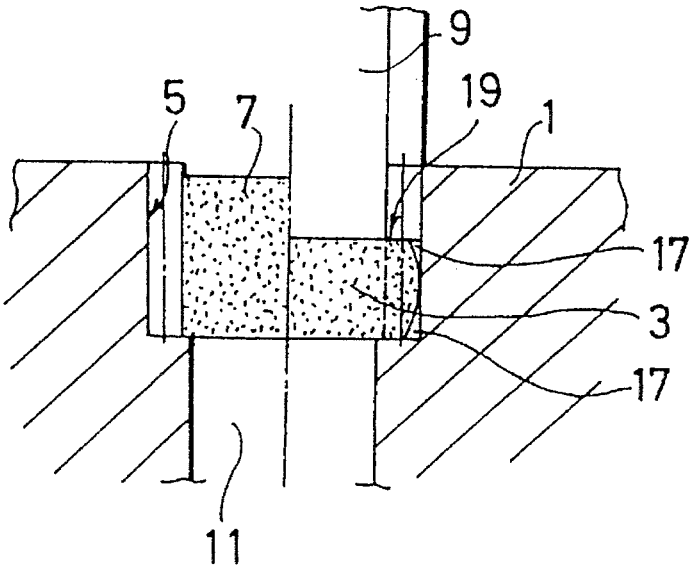
FIG.26 Prior Art
FIG. 26 is an explanatory view to illustrate a conventional plastic working method for a part without any hole.
Figure 27:
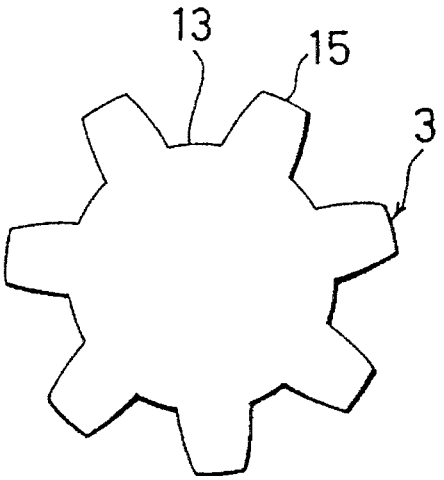
FIG.27 Prior Art
FIG. 27 is a top view to show a gear worked by the method of FIG. 26.
Figure 28:
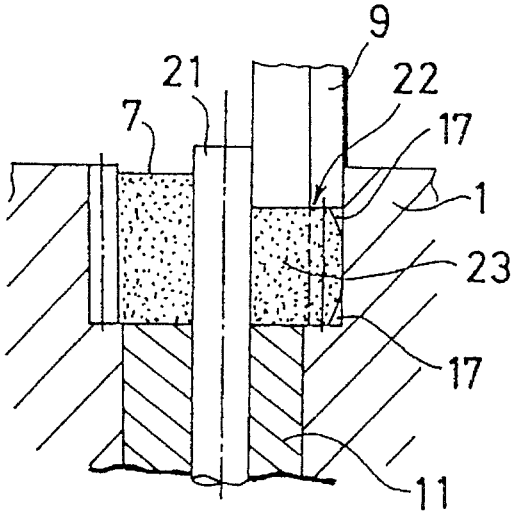
FIG.28 Prior Art
FIG. 28 is an explanatory view to show a conventional plastic working method for a holed metal part.
Figure 29:
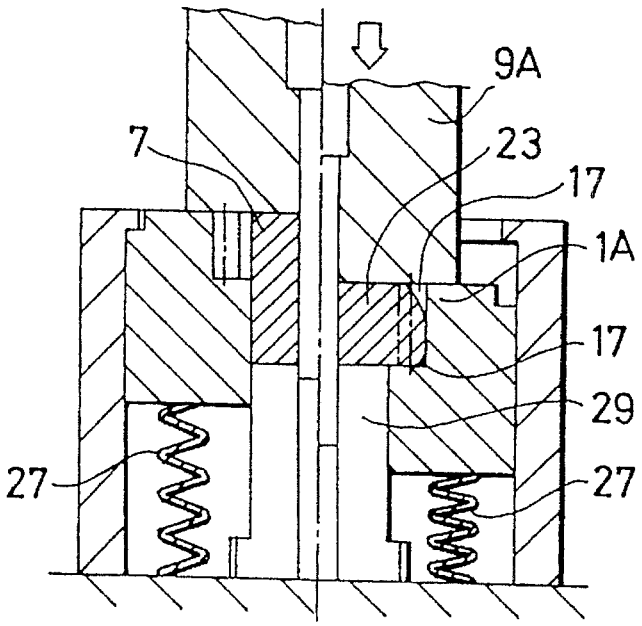
FIG.29 Prior Art
FIG. 29 is an explanatory view to show another example of conventional plastic working method for a holed metal part.

FIG. 25 shows an underfill at a tooth top (A in FIG. 24) when the die member 31 is heated to 100° C. to form under the same conditions.

An underfill 139 formed is 0.05 mm in radial direction and 0.015 mm in axial direction.

This underfill is substantially of an ignorable size in view of product properties.

It is required to apply an average stress of 160 kg/mm2 in order to reduce the size of the underfill 137 formed at room temperature to that of the underfill 139 in FIG. 25.

What is claimed is:

1. A plastic working method for a holed metal part comprising placing a holed blank with a through hole at the center in a die member which has a die and a container continuing to the die and is pushed toward a punch, inserting into the through hole a large cross sectional part of a mandrel which has cross sections with at least two different cross-sectional areas, compressing the blank by a counter punch fitting with the container and a punch pressing the die end face of the die member toward the counter punch to cause the blank to plastically flow into a space formed between the die hole of the die and the large cross sectional part of the mandrel, and while applying a compressive force to the blank by the punch and the counter punch, pulling out the large cross sectional part of the mandrel out of the blank through hole while inserting a small cross sectional part of the mandrel into the through hole so as to plastically flow the blank into a gap between the small cross sectional part of the mandrel and the through hole.

2. A plastic working method for a holed metal part comprising placing a holed blank with a through hole at the center in a die member which has a die and a container continuing to the die and is pushed toward a punch, inserting into the punch side of the through hole a small cross sectional part of a mandrel which has cross sections with at least two different cross-sectional areas, press fitting a diameter enlarging part continuing to the small cross sectional part to the through hole to enlarge the punch side of the through hole, compressing the blank by a counter punch fitting with the container and a punch pressing the die end face of the die member toward the counter punch to cause the blank to plastically flow into a space formed between the die hole of the die and the mandrel, and while applying a compressive force to the blank by the punch and the counter punch, pulling out the diameter enlarging part of the mandrel out of the blank through hole while inserting a small cross sectional part of the mandrel into the through hole so as to plastically flow the blank into a gap between the small cross sectional part of the mandrel and the through hole enlarged by the diameter enlarging part.

3. A plastic working method for a holed metal part comprising placing a holed blank with a through hole at the center in a die member which has a die and a container continuing to the die and is pushed toward a punch, inserting into the through hole a small cross sectional part of a mandrel which has cross sections with at least two different cross-sectional areas, compressing the blank by a counter punch fitting with the container and a punch pressing the die end face of the die member toward the counter punch to cause the blank to plastically flow into a space formed between the die hole of the die and the mandrel, press fitting a diameter enlarging part continuing to the small cross sectional part of the mandrel to the through hole to enlarge the punch side of the through hole, and while applying a compressive force to the blank by the punch and the counter punch, pulling out the diameter enlarging part of the mandrel out of the blank through hole while inserting a small cross sectional part of the mandrel into the through hole so as to plastically flow the blank into a gap between the small cross sectional part of the mandrel and the through hole enlarged by the diameter enlarging part.

4. A plastic working method for a holed metal part according to claim 1 wherein a relief having a diameter small than the outer diameter of the small cross sectional part is formed between the small cross sectional part and the large cross sectional part or the diameter enlarging part of said mandrel and, when inserting the small cross sectional part of the mandrel with pulling out said mandrel, the blank is flowed into said relief under the effect of the compressive force and said flowed blank is ironed by said small diameter part in order to finish the inner side of the holed metal part.

5. A plastic working method for a holed metal part according to claim 1 wherein a driving pin is provided with a mandrel driving part and a knockout part so that the pulling of said mandrel and knocking out of the product are performed in two-step operation of the same knockout device.

6. A plastic working method for a holed metal part according to claim 1 wherein said die and said container are formed as separate units.

7. A plastic working method for a holed metal part according to claim 1 wherein forming is performed with said die member heated to a predetermined temperature.

8. A plastic working method for a holed metal part according to claim 2 wherein a relief having a diameter small than the outer diameter of the small cross sectional part is formed between the small cross sectional part and the large cross sectional part or the diameter enlarging part of said mandrel and, when inserting the small cross sectional part of the mandrel with pulling out said mandrel, the blank is flowed into said relief under the effect of the compressive force and said flowed blank is ironed by said small diameter part in order to finish the inner side of the holed metal part.

9. A plastic working method for a holed metal part according to claim 3 wherein a relief having a diameter small than the outer diameter of the small cross sectional part is formed between the small cross sectional part and the large cross sectional part or the diameter enlarging part of said mandrel and, when inserting the small cross sectional part of the mandrel with pulling out said mandrel, the blank is flowed into said relief under the effect of the compressive force and said flown blank is ironed by said small diameter part in order to finish the inner side of the holed metal part.

10. A plastic working method for a holed metal part according to claim 2 wherein a driving pin is provided with a mandrel driving part and a knockout part so that the pulling of said mandrel and knocking out of the product are performed in two-step operation of the same knockout device.

11. A plastic working method for a holed metal part according to claim 3 wherein a driving pin is provided with a mandrel driving part and a knockout part so that the pulling of said mandrel and knocking out of the product are performed in two-step operation of the same knockout device.

12. A plastic working method for a holed metal part according to claim 2 wherein said die and said container are formed as separate units.

13. A plastic working method for a holed metal part according to claim 3 wherein said die and said container are formed as separate units.

14. A plastic working method for a holed metal part according to claim 2 wherein forming is performed with said die member heated to a predetermined temperature.

15. A plastic working method for a holed metal part according to claim 3 wherein forming is performed with said die member heated to a predetermined temperature.

* * * * *

UNITED STATES PATENT AND TRADEMARK OFFICE

CERTIFICATE OF CORRECTION

PATENT NO. : 5,455,002
DATED : Oct. 3, 1995
INVENTOR(S) : Kobayashi et al.

It is certified that error appears in the above-indentified patent and that said Letters Patent is hereby corrected as shown below:

In the Claims:

Column 10, line 52, replace "small" with -- smaller --;
Column 11, line 6, replace "small" with -- smaller --;
line 16, replace "small" with -- smaller --.

Signed and Sealed this
Fourteenth Day of May, 1996

Bruce Lehman

*Attest:*

BRUCE LEHMAN

*Attesting Officer*

*Commissioner of Patents and Trademarks*